US010629038B2

(12) United States Patent
Horgan et al.

(10) Patent No.: US 10,629,038 B2
(45) Date of Patent: Apr. 21, 2020

(54) ACCESS CONTROL SYSTEM WITH LOCK DEFEAT DEVICE DETECTION

(71) Applicant: Johnson Controls Technology Company, Auburn Hills, MI (US)

(72) Inventors: Donagh S. Horgan, Cork (IE); Jan R. Holliday, Maryville, IL (US); Eamonn O'Toole, County Cork (IE)

(73) Assignee: Johnson Controls Technology Company, Auburn Hills, MI (US)

( * ) Notice: Subject to any disclaimer, the term of this patent is extended or adjusted under 35 U.S.C. 154(b) by 0 days.

(21) Appl. No.: 16/119,172

(22) Filed: Aug. 31, 2018

(65) Prior Publication Data

US 2020/0074821 A1 Mar. 5, 2020

(51) Int. Cl.

| | |
|---|---|
| ***G08B 13/02*** | (2006.01) |
| ***G08B 13/06*** | (2006.01) |
| ***G08B 25/00*** | (2006.01) |
| ***G08B 29/22*** | (2006.01) |

(52) U.S. Cl.

CPC ..... *G08B 13/06* (2013.01); *G08B 25/001* (2013.01); *G08B 29/22* (2013.01)

(58) Field of Classification Search

CPC ..... G08B 13/06; G08B 29/046

See application file for complete search history.

(56) References Cited

U.S. PATENT DOCUMENTS

| | | | | |
|---|---|---|---|---|
| 9,165,123 | B1 * | 10/2015 | Mallard | G06F 21/31 |
| 2002/0067259 | A1 * | 6/2002 | Fufidio | G07C 9/00031 340/541 |
| 2005/0046564 | A1 * | 3/2005 | Eskildsen | E05B 45/06 340/506 |
| 2013/0063241 | A1 * | 3/2013 | Simon | G08B 25/008 340/3.1 |

* cited by examiner

*Primary Examiner* — Hongmin Fan

(74) *Attorney, Agent, or Firm* — Foley & Lardner LLP

(57) ABSTRACT

A building security system. The building security system includes a door analysis system for the building for detecting a lock defeat device (LDD) installed at a door of the building. The door analysis system includes a processing circuit configured to receive door data for the door of the building from an access control system, the door data including a plurality of door events; determine whether the LDD has been installed at the door by analyzing the plurality of door events with one or more LDD indicators; and generate an LDD event indicating that the LDD has been installed at the door in response to a determination that the LDD has been installed at the door based on an analysis with the one or more LDD indicators.

20 Claims, 17 Drawing Sheets

ACCESS CONTROL SYSTEM WITH LOCK DEFEAT DEVICE DETECTION

BACKGROUND

The present disclosure relates generally to an access control system (ACS). An ACS is a computer-aided and networked system for controlling and monitoring physical access to secured parts of a building or other enclosed area, based on the access credentials and privileges of building users. An ACS may manage groups of buildings in disparate locations and across large campuses. An ACS may use various methods for monitoring, authenticating, and controlling access.

More particularly, the present disclosure relates to an automated system for detecting lock defeat devices (LDD) used for the deliberate tampering with or jamming of the door lock of an access controlled door, using methods of analyzing and interpreting event data generated by a site ACS.

SUMMARY

One implementation of the present disclosure is a building security system including a door analysis system for the building for detecting a lock defeat device (LDD) installed at a door of the building. The door analysis system includes a processing circuit configured to receive door data for the door of the building from an access control system, the door data including a door events; determine whether the LDD has been installed at the door by analyzing door events with one or more LDD indicators; and generate an LDD event indicating that the LDD has been installed at the door in response to a determination that the LDD has been installed at the door based on an analysis with the one or more LDD indicators.

In some embodiments, the building security system includes the access control system. The access control system includes a door lock for the door configured to lock or unlock the door. The lock defeat device is installed at the door lock of the door and prevents the door lock from locking the door. The access control system includes a controller configured to cause the door lock of the door to lock the door or unlock the door, collect the door data for the door, and communicate, via a network, the door data for the door to the door analysis system.

In some embodiments, the processing circuit is configured to receive a suppression time period, the suppression time period indicating a length of time to suppress the LDD event for the door; determine a second LDD event subsequent to determining the LDD event; and suppress the second LDD event in response to the second LDD event occurring within the suppression time period from the LDD event occurring.

In some embodiments, the processing circuit is configured to collect historical data indicating usage patterns of the door from the access control system; perform machine learning with the historical data to generate the one or more LDD indicators; collect new historical data from the access control system, the new historical data occurring after the collected historical data, the new historical data indicating new usage patterns of the door; and perform additional machine learning with the new historical data to generate updates to the one or more LDD indicators, the updates comprising at least one of generating a new LDD indicator or adjusting an existing LDD indicator of the one or more LDD indicators.

In some embodiments, the events include a door forced open (DFO) event and an authentication event. The one or more LDD indicators includes a co-occurs indicator. The processing circuit is configured to analyze the plurality of door events with the co-occurs indicator by determining whether the DFO event occurs within a predefined amount of time of the authentication event occurring and generating the LDD event in response to a determination that the DFO event occurs within the predefined amount of time of the authentication event occurring.

In some embodiments, the events include a plurality of access granted but door not used (AGDNU) events, each of the plurality of AGDNU events indicating that the door was unlocked but the door was not opened. The one or more LDD indicators includes a high AGDNU indicator. The processing circuit is configured to analyze the door events with the high AGDNU indicator by determining a number of the AGDNU events based on the plurality of AGDNU events; determining whether the number of the AGDNU events is greater than a sensitivity threshold; and generating the LDD event in response to a determination that the number of the AGDNU events is greater than the sensitivity threshold.

In some embodiments, the events include a door held open (DHO) event and an authentication event. The one or more LDD indicators includes an in-progress indicator. The processing circuit is configured to analyze the plurality of door events with the in-progress indicator by determining that the authentication event occurs while the DHO event is occurring and generating the lock defeat device event in response to a determination that the authentication event occurs while the DHO event is occurring.

In some embodiments, the processing circuit is configured to generate a risk score for the building, the risk score indicating an amount of risk that the building is experiencing, and update a value of the risk score in response to a generation of the LDD event.

In some embodiments, analyzing the door data for the door with the one or more LDD indicators includes determining whether criteria of each of the one or more LDD indicators is met based on the plurality of door events. The processing circuit is configured to generate the LDD event indicating that the LDD has been installed at the door in response to the determination that the LDD has been installed at the door based on the criteria of at least one of the one or more LDD indications being met based on the door events.

In some embodiments, the LDD event can be a plurality of different LDD events, each type of the LDD event corresponding to one of the one or more LDD indicators.

Another implementation of the present disclosure is a method for detecting a lock defeat device (LDD) installed at a door of a building. The method includes receiving, by a door analysis system, door data for the door of the building from an access control system, the door data including a door events; determining, by the door analysis system, whether the LDD has been installed at the door by analyzing the plurality of door events with one or more LDD indicators; and generating, by the door analysis system, an LDD event indicating that the LDD has been installed at the door in response to a determination that the LDD has been installed at the door based on an analysis with the one or more LDD indicators.

In some embodiments, the method includes receiving, by the door analysis system, a suppression time period, the suppression time period indicating a length of time to suppress the LDD event for the door; determining, by the door analysis system, a second LDD event subsequent to determining the LDD event; and suppressing, by the door analysis system, the second LDD event in response to the second LDD event occurring within the suppression time period from the LDD event occurring.

In some embodiments, the method includes collecting, by the door analysis system, historical data indicating usage patterns of the door from the access control system; performing, by the door analysis system, machine learning with the historical data to generate the one or more LDD indicators; collecting, by the door analysis system, new historical data from the access control system, the new historical data occurring after the collected historical data, the new historical data indicating new usage patterns of the door; and performing, by the door analysis system, additional machine learning with the new historical data to generate updates to the one or more LDD indicators, the updates including at least one of generating a new LDD indicator or adjusting an existing LDD indicator of the one or more LDD indicators.

In some embodiments, the events include a door forced open (DFO) event and an authentication event. The one or more LDD indicators includes a co-occurs indicator. Analyzing, by the analysis system, the plurality of door events with the co-occurs indicator includes determining, by the analysis system, whether the DFO event occurs within a predefined amount of time of the authentication event occurring and generating, by the analysis system, the LDD event in response to a determination that the DFO event occurs within the predefined amount of time of the authentication event occurring.

In some embodiments, the events include a plurality of access granted but door not used (AGDNU) events, each of the plurality of AGDNU events indicating that the door was unlocked but the door was not opened. The one or more LDD indicators includes a high AGDNU indicator. Analyzing, by the analysis system, the plurality of door events with the high AGDNU indicator includes determining, by the analysis system, a number of the plurality of AGDNU events based on the plurality of AGDNU events; determining, by the analysis system, whether the number of the AGDNU events is greater than a sensitivity threshold; and generating, by the analysis system, the LDD event in response to a determination that the number of the AGDNU events is greater than the sensitivity threshold.

In some embodiments, the plurality of events include a door held open (DHO) event and an authentication event. The one or more LDD indicators includes an in-progress indicator. Analyzing, by the analysis system, the plurality of door events with the in-progress indicator includes determining, by the analysis system, that the authentication event occurs while the DHO event is occurring and generating, by the analysis system, the lock defeat device event in response to a determination that the authentication event occurs while the DHO event is occurring.

Another implementation of the present disclosure is an access control system for a building including a door lock for the door, the door lock configured to lock or unlock the door. The lock defeat device is installed at the door lock of the door and prevents the door lock from locking the door. The access control system includes a processing circuit configured to receive door data for the door of the building, the door data comprising a plurality of door events; determine whether the LDD has been installed at the door by analyzing the plurality of door events with one or more LDD indicators; and generate an LDD event indicating that the LDD has been installed at the door in response to a determination that the LDD has been installed at the door based on an analysis with the one or more LDD indicators.

In some embodiments, the plurality of events include a door forced open (DFO) event and an authentication event. The one or more LDD indicators includes a co-occurs indicator. The processing circuit is configured to analyze the plurality of door events with the co-occurs indicator by determining whether the DFO event occurs within a predefined amount of time of the authentication event occurring and generating the LDD event in response to a determination that the DFO event occurs within the predefined amount of time of the authentication event occurring.

In some embodiments, the plurality of events include a plurality of access granted but door not used (AGDNU) events, each of the plurality of AGDNU events indicating that the door was unlocked but the door was not opened. The one or more LDD indicators includes a high AGDNU indicator. The processing circuit is configured to analyze the plurality of door events with the high AGDNU indicator by determining a number of the plurality of AGDNU events based on the plurality of AGDNU events; determining whether the number of the AGDNU events is greater than a sensitivity threshold; and generating the LDD event in response to a determination that the number of the AGDNU events is greater than the sensitivity threshold.

In some embodiments, the plurality of events include a door held open (DHO) event and an authentication event. The one or more LDD indicators includes an in-progress indicator. The processing circuit is configured to analyze the plurality of door events with the in-progress indicator by determining that the authentication event occurs while the DHO event is occurring and generating the lock defeat device event in response to a determination that the authentication event occurs while the DHO event is occurring.

In some embodiments a system for monitoring access-controlled doors includes a door lock in communication with at least one door sensor, a relay switch configured to send and receive signals corresponding to the at least one door sensor, an access device configured to receive an access request from a user, and an access controller in communication with the relay switch, the at least one door sensor, and the access device. The access controller is configured to receive the access request from the access device, determine a lock state corresponding to the at least one door sensor, transmit the access request and the lock state to a server to determine an access event, receive a response from the server corresponding to the access event, and generate an alert based on the access event.

In some embodiments, the access controller includes a machine learning module configured to generate access event patterns using a plurality of access requests, each access request associated with an access time and a current lock state, compare the access event to the access event patterns prior to generating the alert, and update the access event patterns using each subsequent access request.

In some embodiments, the access controller is further configured to assign a priority level to each access event and reorder, based on the respective priority level of each access event, an alarm management list.

In some embodiments, the access controller is further configured to at least one of create, suppress, and escalate an alarm corresponding to the alert.

In some embodiments, the access request includes credential data and the response from the server includes an indication to grant access or deny access.

In some embodiments, the access controller is further configured to initiate an unlock command to the door lock, in response to the indication to grant access.

In some embodiments, the access device is configured to communicate with the user based on the indication to grant access or deny access.

In some embodiments is a method for monitoring access-controlled doors includes receiving an access request from an access device, determining a lock state corresponding to at least one door sensor, transmitting the access request and the lock state to a server to determine an access event, receiving a response from the server corresponding to the access event, and generating an alert based on the access event.

In some embodiments, the method includes using a machine learning module. Using a machine learning module includes generating access event patterns using a plurality of access requests, each access request associated with an access time and a current lock state, comparing the access event to the access event patterns prior to generating the alert, and updating the access event patterns using each subsequent access request.

In some embodiments, the step of receiving a response from the server corresponding to the access event includes assigning a priority level to each access event and reordering, based on the respective priority level of each access event, an alarm management list.

In some embodiments, the step of generating an alert based on the access event includes at least one of creating, suppressing, and escalating an alarm corresponding to the alert.

In some embodiments, the step of receiving a response from the server corresponding to the access event includes including credential data with the access request and receiving an indication to grant access or deny access.

In some embodiments, the method includes initiating an unlock command to the door lock, in response to the indication to grant access.

In some embodiments, the method includes communicating with the user based on the indication to grant access or deny access.

In some embodiments, an access controller for monitoring access-controlled doors includes at least one controller interface configured to communicate with a relay switch, at least one door sensor, and an access device. The access controller also includes a processing circuit configured to receive an access request from the access device, determine a lock state corresponding to the at least one door sensor, transmit the access request and the lock state to a server to determine an access event, receive a response from the server corresponding to the access event, and generate an alert based on the access event.

In some embodiments, the access controller includes a machine learning module configured to generate access event patterns using a plurality of access requests, each access request associated with an access time and a current lock state, compare the access event to the access event patterns prior to generating the alert, and update the access event patterns using each subsequent access request.

In some embodiments, the access controller is further configured to assign a priority level to each access event and reorder, based on the respective priority level of each access event, an alarm management list.

In some embodiments, the access controller is further configured to at least one of create, suppress, and escalate an alarm corresponding to the alert.

In some embodiments, the access request includes credential data and the response from the server includes an indication to grant access or deny access.

In some embodiments, the access controller is further configured to initiate an unlock command to the door lock, in response to the indication to grant access.

BRIEF DESCRIPTION OF THE DRAWINGS

Various objects, aspects, features, and advantages of the disclosure will become more apparent and better understood by referring to the detailed description taken in conjunction with the accompanying drawings, in which like reference characters identify corresponding elements throughout. In the drawings, like reference numbers generally indicate identical, functionally similar, and/or structurally similar elements.

DETAILED DESCRIPTION

Building HVAC Systems and Building Management Systems

Figure 1:
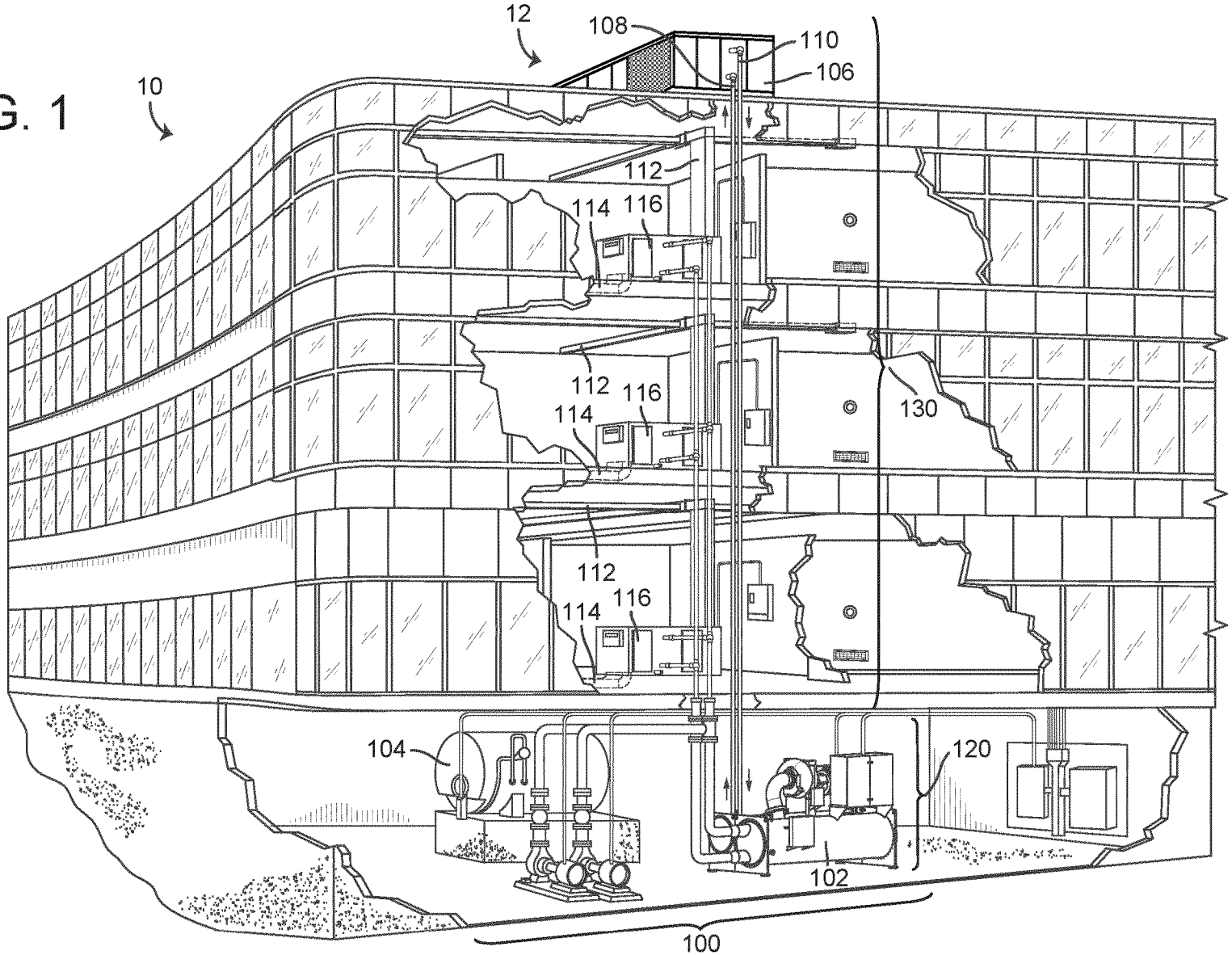
FIG. 1 is a schematic drawing of a building equipped with a HVAC system, according to some embodiments.
Figure 2:
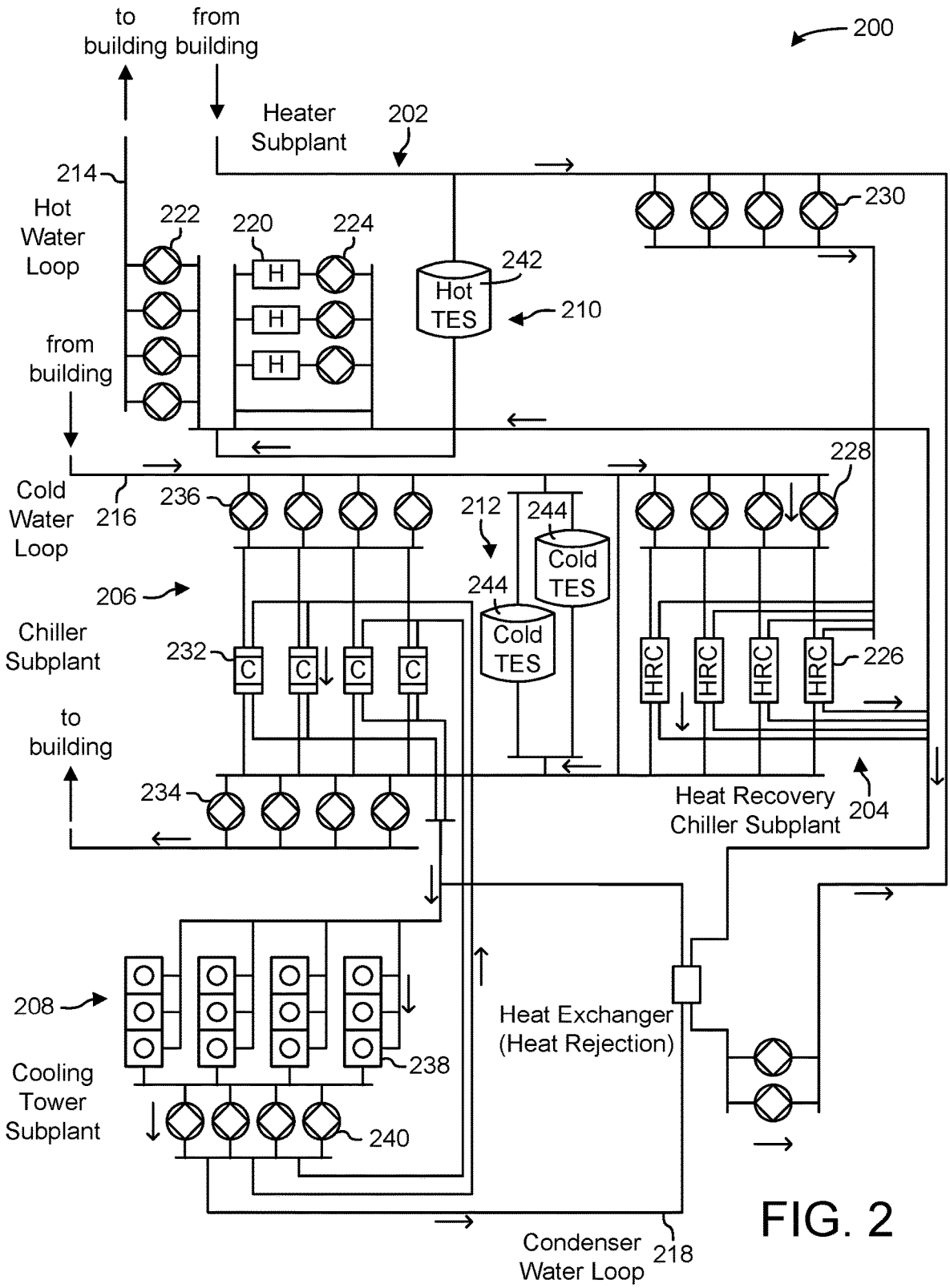
FIG. 2 is a block diagram of a waterside system which can be used to serve the building of FIG. 1, according to some embodiments.
Figure 3:
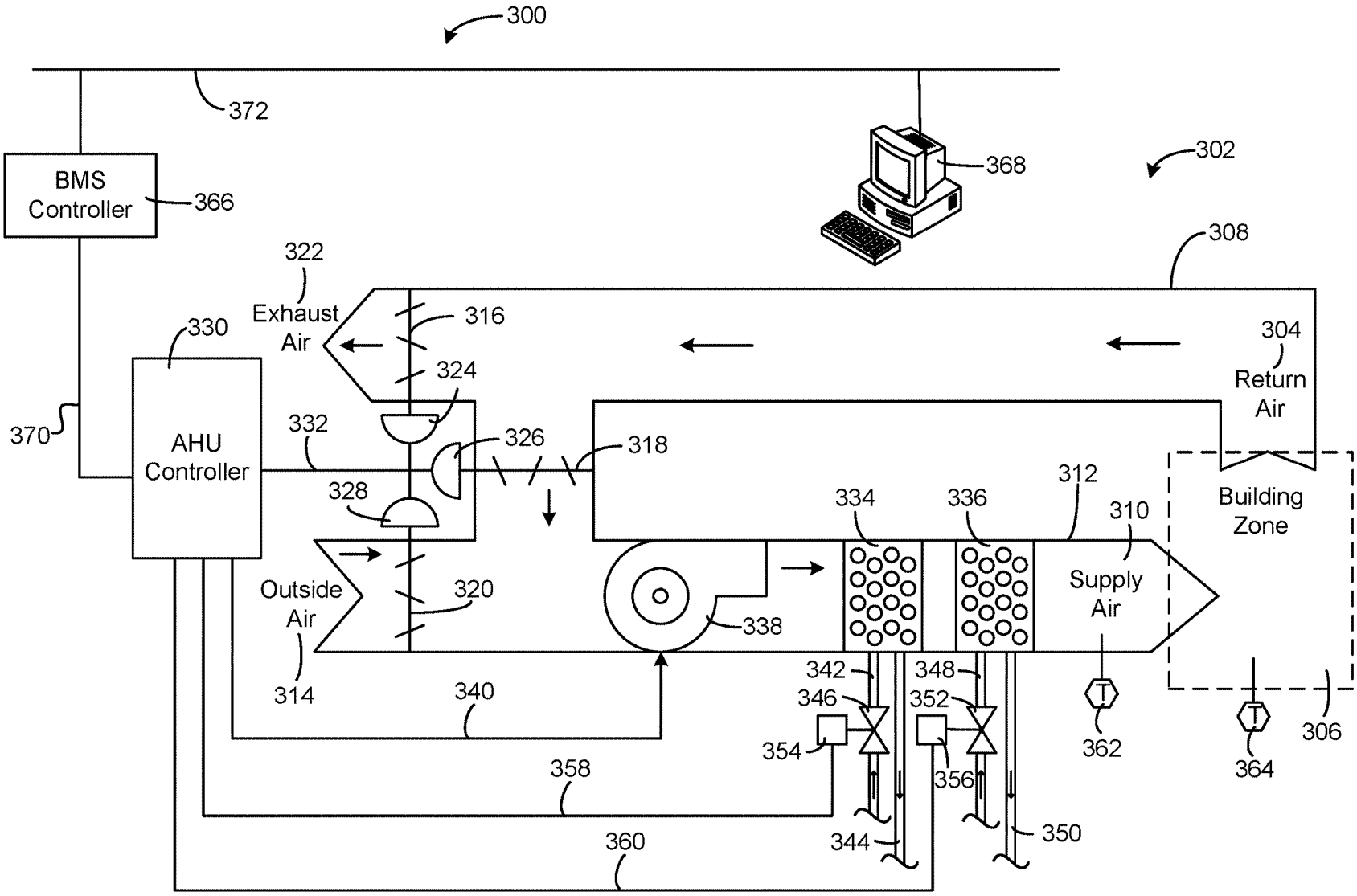
FIG. 3 is a block diagram of an airside system which can be used to serve the building of FIG. 1, according to some embodiments.
Figure 4:
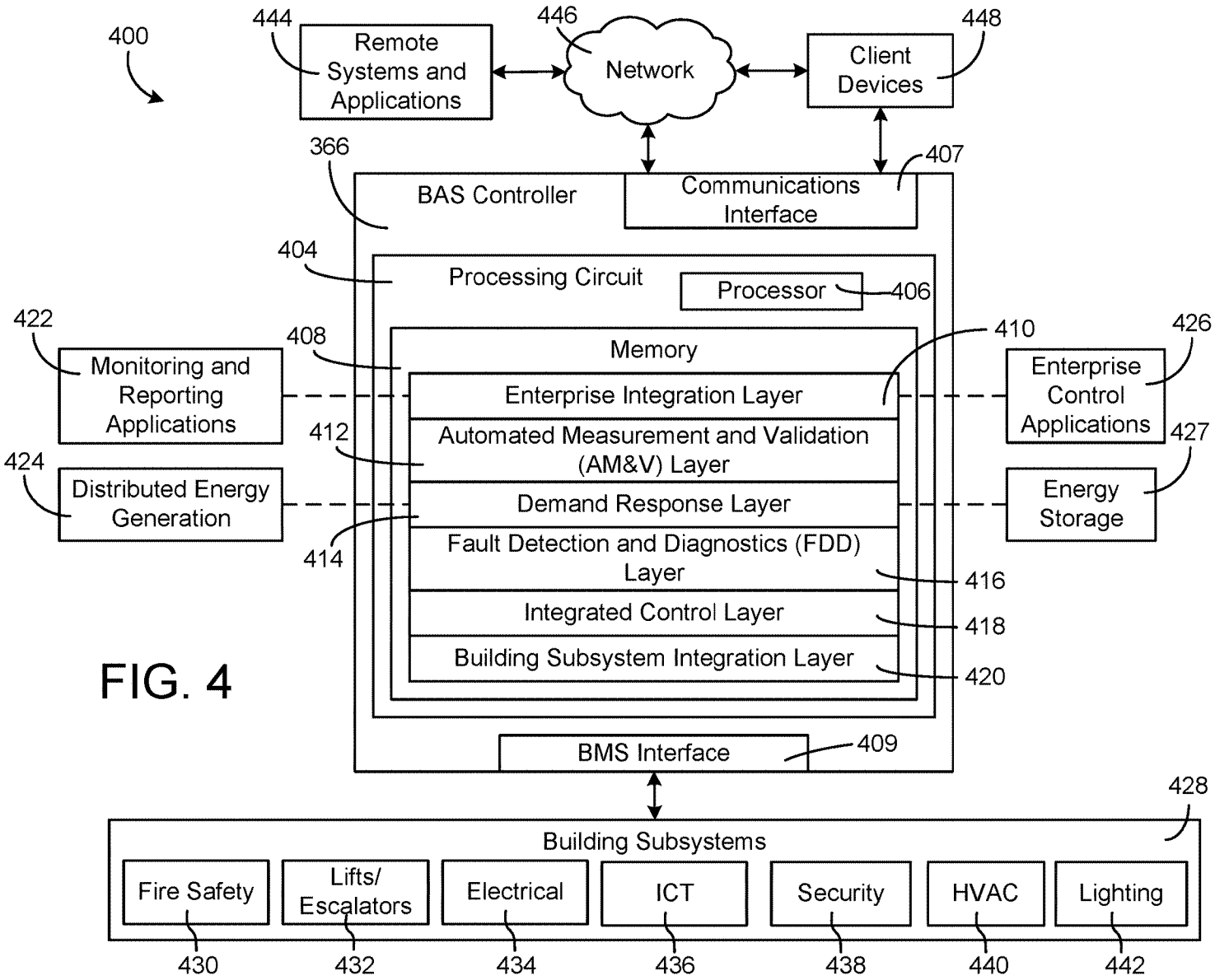
FIG. 4 is a block diagram of a building management system (BMS) which can be used to monitor and control the building of FIG. 1, according to some embodiments.

Referring now to FIGS. 1-4, several building management systems (BMS) and HVAC systems in which the systems and methods of the present disclosure can be implemented are shown, according to some embodiments. In brief overview, FIG. 1 shows a building 10 equipped with a HVAC system 100. FIG. 2 is a block diagram of a waterside system 200 which can be used to serve building 10. FIG. 3 is a block diagram of an airside system 300 which can be used to serve building 10. FIG. 4 is a block diagram of a BMS which can be used to monitor and control building 10.

Building and HVAC System

Referring particularly to FIG. 1, a perspective view of a building 10 is shown. Building 10 is served by a BMS. A BMS is, in general, a system of devices configured to control, monitor, and manage equipment in or around a building or building area. A BMS can include, for example, a HVAC system, a security system, a lighting system, a fire alerting system, any other system that is capable of managing building functions or devices, or any combination thereof.

The BMS that serves building 10 includes a HVAC system 100. HVAC system 100 can include a number of HVAC devices (e.g., heaters, chillers, air handling units, pumps, fans, thermal energy storage, etc.) configured to provide heating, cooling, ventilation, or other services for building 10. For example, HVAC system 100 is shown to include a waterside system 120 and an airside system 130. Waterside system 120 can provide a heated or chilled fluid to an air handling unit of airside system 130. Airside system 130 can use the heated or chilled fluid to heat or cool an airflow provided to building 10. An exemplary waterside system and airside system which can be used in HVAC system 100 are described in greater detail with reference to FIGS. 2-3.

HVAC system 100 is shown to include a chiller 102, a boiler 104, and a rooftop air handling unit (AHU) 106. Waterside system 120 can use boiler 104 and chiller 102 to heat or cool a working fluid (e.g., water, glycol, etc.) and can circulate the working fluid to AHU 106. In various embodiments, the HVAC devices of waterside system 120 can be located in or around building 10 (as shown in FIG. 1) or at an offsite location such as a central plant (e.g., a chiller plant, a steam plant, a heat plant, etc.). The working fluid can be heated in boiler 104 or cooled in chiller 102, depending on whether heating or cooling is required in building 10. Boiler 104 can add heat to the circulated fluid, for example, by burning a combustible material (e.g., natural gas) or using an electric heating element. Chiller 102 can place the circulated fluid in a heat exchange relationship with another fluid (e.g., a refrigerant) in a heat exchanger (e.g., an evaporator) to absorb heat from the circulated fluid. The working fluid from chiller 102 and/or boiler 104 can be transported to AHU 106 via piping 108.

AHU 106 can place the working fluid in a heat exchange relationship with an airflow passing through AHU 106 (e.g., via one or more stages of cooling coils and/or heating coils). The airflow can be, for example, outside air, return air from within building 10, or a combination of both. AHU 106 can transfer heat between the airflow and the working fluid to provide heating or cooling for the airflow. For example, AHU 106 can include one or more fans or blowers configured to pass the airflow over or through a heat exchanger containing the working fluid. The working fluid can then return to chiller 102 or boiler 104 via piping 110.

Airside system 130 can deliver the airflow supplied by AHU 106 (i.e., the supply airflow) to building 10 via air supply ducts 112 and can provide return air from building 10 to AHU 106 via air return ducts 114. In some embodiments, airside system 130 includes multiple variable air volume (VAV) units 116. For example, airside system 130 is shown to include a separate VAV unit 116 on each floor or zone of building 10. VAV units 116 can include dampers or other flow control elements that can be operated to control an amount of the supply airflow provided to individual zones of building 10. In other embodiments, airside system 130 delivers the supply airflow into one or more zones of building 10 (e.g., via supply ducts 112) without using intermediate VAV units 116 or other flow control elements. AHU 106 can include various sensors (e.g., temperature sensors, pressure sensors, etc.) configured to measure attributes of the supply airflow. AHU 106 can receive input from sensors located within AHU 106 and/or within the building zone and can adjust the flow rate, temperature, or other attributes of the supply airflow through AHU 106 to achieve setpoint conditions for the building zone.

Waterside System

Referring now to FIG. 2, a block diagram of a waterside system 200 is shown, according to some embodiments. In various embodiments, waterside system 200 can supplement or replace waterside system 120 in HVAC system 100 or can be implemented separate from HVAC system 100. When implemented in HVAC system 100, waterside system 200 can include a subset of the HVAC devices in HVAC system 100 (e.g., boiler 104, chiller 102, pumps, valves, etc.) and can operate to supply a heated or chilled fluid to AHU 106. The HVAC devices of waterside system 200 can be located within building 10 (e.g., as components of waterside system 120) or at an offsite location such as a central plant.

In FIG. 2, waterside system 200 is shown as a central plant having a number of subplants 202-212. Subplants 202-212 are shown to include a heater subplant 202, a heat recovery chiller subplant 204, a chiller subplant 206, a cooling tower subplant 208, a hot thermal energy storage (TES) subplant 210, and a cold thermal energy storage (TES) subplant 212. Subplants 202-212 consume resources (e.g., water, natural gas, electricity, etc.) from utilities to serve thermal energy loads (e.g., hot water, cold water, heating, cooling, etc.) of a building or campus. For example, heater subplant 202 can be configured to heat water in a hot water loop 214 that circulates the hot water between heater subplant 202 and building 10. Chiller subplant 206 can be configured to chill water in a cold water loop 216 that circulates the cold water between chiller subplant 206 building 10. Heat recovery chiller subplant 204 can be configured to transfer heat from cold water loop 216 to hot water loop 214 to provide additional heating for the hot water and additional cooling for the cold water. Condenser water loop 218 can absorb heat from the cold water in chiller subplant 206 and reject the absorbed heat in cooling tower subplant 208 or transfer the absorbed heat to hot water loop 214. Hot TES subplant 210 and cold TES subplant 212 can store hot and cold thermal energy, respectively, for subsequent use.

Hot water loop 214 and cold water loop 216 can deliver the heated and/or chilled water to air handlers located on the rooftop of building 10 (e.g., AHU 106) or to individual floors or zones of building 10 (e.g., VAV units 116). The air handlers push air past heat exchangers (e.g., heating coils or cooling coils) through which the water flows to provide heating or cooling for the air. The heated or cooled air can be delivered to individual zones of building 10 to serve thermal energy loads of building 10. The water then returns to subplants 202-212 to receive further heating or cooling.

Although subplants 202-212 are shown and described as heating and cooling water for circulation to a building, it is understood that any other type of working fluid (e.g., glycol, CO2, etc.) can be used in place of or in addition to water to serve thermal energy loads. In other embodiments, subplants 202-212 can provide heating and/or cooling directly to the building or campus without requiring an intermediate heat transfer fluid. These and other variations to waterside system 200 are within the teachings of the present disclosure.

Each of subplants 202-212 can include a variety of equipment configured to facilitate the functions of the subplant. For example, heater subplant 202 is shown to include a number of heating elements 220 (e.g., boilers, electric heaters, etc.) configured to add heat to the hot water in hot water loop 214. Heater subplant 202 is also shown to include several pumps 222 and 224 configured to circulate the hot water in hot water loop 214 and to control the flow rate of the hot water through individual heating elements 220. Chiller subplant 206 is shown to include a number of chillers 232 configured to remove heat from the cold water in cold water loop 216. Chiller subplant 206 is also shown to include several pumps 234 and 236 configured to circulate the cold water in cold water loop 216 and to control the flow rate of the cold water through individual chillers 232.

Heat recovery chiller subplant 204 is shown to include a number of heat recovery heat exchangers 226 (e.g., refrigeration circuits) configured to transfer heat from cold water loop 216 to hot water loop 214. Heat recovery chiller subplant 204 is also shown to include several pumps 228 and 230 configured to circulate the hot water and/or cold water through heat recovery heat exchangers 226 and to control the flow rate of the water through individual heat recovery heat exchangers 226. Cooling tower subplant 208 is shown to include a number of cooling towers 238 configured to remove heat from the condenser water in condenser water loop 218. Cooling tower subplant 208 is also shown to include several pumps 240 configured to circulate the condenser water in condenser water loop 218 and to control the flow rate of the condenser water through individual cooling towers 238.

Hot TES subplant 210 is shown to include a hot TES tank 242 configured to store the hot water for later use. Hot TES subplant 210 can also include one or more pumps or valves configured to control the flow rate of the hot water into or out of hot TES tank 242. Cold TES subplant 212 is shown to include cold TES tanks 244 configured to store the cold water for later use. Cold TES subplant 212 can also include one or more pumps or valves configured to control the flow rate of the cold water into or out of cold TES tanks 244.

In some embodiments, one or more of the pumps in waterside system 200 (e.g., pumps 222, 224, 228, 230, 234, 236, and/or 240) or pipelines in waterside system 200 include an isolation valve associated therewith. Isolation valves can be integrated with the pumps or positioned upstream or downstream of the pumps to control the fluid flows in waterside system 200. In various embodiments, waterside system 200 can include more, fewer, or different types of devices and/or subplants based on the particular configuration of waterside system 200 and the types of loads served by waterside system 200.

Airside System

Referring now to FIG. 3, a block diagram of an airside system 300 is shown, according to some embodiments. In various embodiments, airside system 300 can supplement or replace airside system 130 in HVAC system 100 or can be implemented separate from HVAC system 100. When implemented in HVAC system 100, airside system 300 can include a subset of the HVAC devices in HVAC system 100 (e.g., AHU 106, VAV units 116, ducts 112-114, fans, dampers, etc.) and can be located in or around building 10. Airside system 300 can operate to heat or cool an airflow provided to building 10 using a heated or chilled fluid provided by waterside system 200.

In FIG. 3, airside system 300 is shown to include an economizer-type air handling unit (AHU) 302. Economizer-type AHUs vary the amount of outside air and return air used by the air handling unit for heating or cooling. For example, AHU 302 can receive return air 304 from building zone 306 via return air duct 308 and can deliver supply air 310 to building zone 306 via supply air duct 312. In some embodiments, AHU 302 is a rooftop unit located on the roof of building 10 (e.g., AHU 106 as shown in FIG. 1) or otherwise positioned to receive both return air 304 and outside air 314. AHU 302 can be configured to operate exhaust air damper 316, mixing damper 318, and outside air damper 320 to control an amount of outside air 314 and return air 304 that combine to form supply air 310. Any return air 304 that does not pass through mixing damper 318 can be exhausted from AHU 302 through exhaust damper 316 as exhaust air 322.

Each of dampers 316-320 can be operated by an actuator. For example, exhaust air damper 316 can be operated by actuator 324, mixing damper 318 can be operated by actuator 326, and outside air damper 320 can be operated by actuator 328. Actuators 324-328 can communicate with an AHU controller 330 via a communications link 332. Actuators 324-328 can receive control signals from AHU controller 330 and can provide feedback signals to AHU controller 330. Feedback signals can include, for example, an indication of a current actuator or damper position, an amount of torque or force exerted by the actuator, diagnostic information (e.g., results of diagnostic tests performed by actuators 324-328), status information, commissioning information, configuration settings, calibration data, and/or other types of information or data that can be collected, stored, or used by actuators 324-328. AHU controller 330 can be an economizer controller configured to use one or more control algorithms (e.g., state-based algorithms, extremum seeking control (ESC) algorithms, proportional-integral (PI) control algorithms, proportional-integral-derivative (PID) control algorithms, model predictive control (MPC) algorithms, feedback control algorithms, etc.) to control actuators 324-328.

Still referring to FIG. 3, AHU 302 is shown to include a cooling coil 334, a heating coil 336, and a fan 338 positioned within supply air duct 312. Fan 338 can be configured to force supply air 310 through cooling coil 334 and/or heating coil 336 and provide supply air 310 to building zone 306. AHU controller 330 can communicate with fan 338 via communications link 340 to control a flow rate of supply air 310. In some embodiments, AHU controller 330 controls an amount of heating or cooling applied to supply air 310 by modulating a speed of fan 338.

Cooling coil 334 can receive a chilled fluid from waterside system 200 (e.g., from cold water loop 216) via piping 342 and can return the chilled fluid to waterside system 200 via piping 344. Valve 346 can be positioned along piping 342 or piping 344 to control a flow rate of the chilled fluid through cooling coil 334. In some embodiments, cooling coil 334 includes multiple stages of cooling coils that can be independently activated and deactivated (e.g., by AHU controller 330, by BMS controller 366, etc.) to modulate an amount of cooling applied to supply air 310.

Heating coil 336 can receive a heated fluid from waterside system 200 (e.g., from hot water loop 214) via piping 348 and can return the heated fluid to waterside system 200 via piping 350. Valve 352 can be positioned along piping 348 or piping 350 to control a flow rate of the heated fluid through heating coil 336. In some embodiments, heating coil 336 includes multiple stages of heating coils that can be independently activated and deactivated (e.g., by AHU controller 330, by BMS controller 366, etc.) to modulate an amount of heating applied to supply air 310.

Each of valves 346 and 352 can be controlled by an actuator. For example, valve 346 can be controlled by actuator 354 and valve 352 can be controlled by actuator 356. Actuators 354-356 can communicate with AHU controller 330 via communications links 358-360. Actuators 354-356 can receive control signals from AHU controller 330 and can provide feedback signals to controller 330. In some embodiments, AHU controller 330 receives a measurement of the supply air temperature from a temperature sensor 362 positioned in supply air duct 312 (e.g., downstream of cooling coil 334 and/or heating coil 336). AHU controller 330 can also receive a measurement of the temperature of building zone 306 from a temperature sensor 364 located in building zone 306.

In some embodiments, AHU controller 330 operates valves 346 and 352 via actuators 354-356 to modulate an amount of heating or cooling provided to supply air 310 (e.g., to achieve a setpoint temperature for supply air 310 or to maintain the temperature of supply air 310 within a setpoint temperature range). The positions of valves 346 and 352 affect the amount of heating or cooling provided to supply air 310 by cooling coil 334 or heating coil 336 and can correlate with the amount of energy consumed to achieve a desired supply air temperature. AHU 330 can control the temperature of supply air 310 and/or building zone 306 by activating or deactivating coils 334-336, adjusting a speed of fan 338, or a combination of both.

Still referring to FIG. 3, airside system 300 is shown to include a building management system (BMS) controller 366 and a client device 368. BMS controller 366 can include one or more computer systems (e.g., servers, supervisory controllers, subsystem controllers, etc.) that serve as system level controllers, application or data servers, head nodes, or master controllers for airside system 300, waterside system 200, HVAC system 100, and/or other controllable systems that serve building 10. BMS controller 366 can communicate with multiple downstream building systems or subsystems (e.g., HVAC system 100, a security system, a lighting system, waterside system 200, etc.) via a communications link 370 according to like or disparate protocols (e.g., LON, BACnet, etc.). In various embodiments, AHU controller 330 and BMS controller 366 can be separate (as shown in FIG. 3) or integrated. In an integrated implementation, AHU controller 330 can be a software module configured for execution by a processor of BMS controller 366.

In some embodiments, AHU controller 330 receives information from BMS controller 366 (e.g., commands, setpoints, operating boundaries, etc.) and provides information to BMS controller 366 (e.g., temperature measurements, valve or actuator positions, operating statuses, diagnostics, etc.). For example, AHU controller 330 can provide BMS controller 366 with temperature measurements from temperature sensors 362-364, equipment on/off states, equipment operating capacities, and/or any other information that can be used by BMS controller 366 to monitor or control a variable state or condition within building zone 306.

Client device 368 can include one or more human-machine interfaces or client interfaces (e.g., graphical user interfaces, reporting interfaces, text-based computer interfaces, client-facing web services, web servers that provide pages to web clients, etc.) for controlling, viewing, or otherwise interacting with HVAC system 100, its subsystems, and/or devices. Client device 368 can be a computer workstation, a client terminal, a remote or local interface, or any other type of user interface device. Client device 368 can be a stationary terminal or a mobile device. For example, client device 368 can be a desktop computer, a computer server with a user interface, a laptop computer, a tablet, a smartphone, a PDA, or any other type of mobile or non-mobile device. Client device 368 can communicate with BMS controller 366 and/or AHU controller 330 via communications link 372.

Building Management Systems

Referring now to FIG. 4, a block diagram of a building management system (BMS) 400 is shown, according to some embodiments. BMS 400 can be implemented in building 10 to automatically monitor and control various building functions. BMS 400 is shown to include BMS controller 366 and a number of building subsystems 428. Building subsystems 428 are shown to include a building electrical subsystem 434, an information communication technology (ICT) subsystem 436, a security subsystem 438, a HVAC subsystem 440, a lighting subsystem 442, a lift/escalators subsystem 432, and a fire safety subsystem 430. In various embodiments, building subsystems 428 can include fewer, additional, or alternative subsystems. For example, building subsystems 428 can also or alternatively include a refrigeration subsystem, an advertising or signage subsystem, a cooking subsystem, a vending subsystem, a printer or copy service subsystem, or any other type of building subsystem that uses controllable equipment and/or sensors to monitor or control building 10. In some embodiments, building subsystems 428 include waterside system 200 and/or airside system 300, as described with reference to FIGS. 2-3.

Each of building subsystems 428 can include any number of devices, controllers, and connections for completing its individual functions and control activities. HVAC subsystem 440 can include many of the same components as HVAC system 100, as described with reference to FIGS. 1-3. For example, HVAC subsystem 440 can include a chiller, a boiler, any number of air handling units, economizers, field controllers, supervisory controllers, actuators, temperature sensors, and other devices for controlling the temperature, humidity, airflow, or other variable conditions within building 10. Lighting subsystem 442 can include any number of light fixtures, ballasts, lighting sensors, dimmers, or other devices configured to controllably adjust the amount of light provided to a building space. Security subsystem 438 can include occupancy sensors, video surveillance cameras, digital video recorders, video processing servers, intrusion detection devices, access control devices and servers, or other security-related devices.

Still referring to FIG. 4, BMS controller 366 is shown to include a communications interface 407 and a BMS interface 409. Interface 407 can facilitate communications between BMS controller 366 and external applications (e.g., monitoring and reporting applications 422, enterprise control applications 426, remote systems and applications 444, applications residing on client devices 448, etc.) for allowing user control, monitoring, and adjustment to BMS controller 366 and/or subsystems 428. Interface 407 can also facilitate communications between BMS controller 366 and client devices 448. BMS interface 409 can facilitate communications between BMS controller 366 and building subsystems 428 (e.g., HVAC, lighting security, lifts, power distribution, business, etc.).

Interfaces 407, 409 can be or include wired or wireless communications interfaces (e.g., jacks, antennas, transmitters, receivers, transceivers, wire terminals, etc.) for conducting data communications with building subsystems 428 or other external systems or devices. In various embodiments, communications via interfaces 407, 409 can be direct (e.g., local wired or wireless communications) or via a communications network 446 (e.g., a WAN, the Internet, a cellular network, etc.). For example, interfaces 407, 409 can include an Ethernet card and port for sending and receiving data via an Ethernet-based communications link or network. In another example, interfaces 407, 409 can include a Wi-Fi transceiver for communicating via a wireless communications network. In another example, one or both of interfaces 407, 409 can include cellular or mobile phone communications transceivers. In one embodiment, communications interface 407 is a power line communications interface and BMS interface 409 is an Ethernet interface. In other embodiments, both communications interface 407 and BMS interface 409 are Ethernet interfaces or are the same Ethernet interface.

Still referring to FIG. 4, BMS controller 366 is shown to include a processing circuit 404 including a processor 406 and memory 408. Processing circuit 404 can be communicably connected to BMS interface 409 and/or communications interface 407 such that processing circuit 404 and the various components thereof can send and receive data via interfaces 407, 409. Processor 406 can be implemented as a general purpose processor, an application specific integrated circuit (ASIC), one or more field programmable gate arrays (FPGAs), a group of processing components, or other suitable electronic processing components.

Memory 408 (e.g., memory, memory unit, storage device, etc.) can include one or more devices (e.g., RAM, ROM, Flash memory, hard disk storage, etc.) for storing data and/or computer code for completing or facilitating the various processes, layers and modules described in the present application. Memory 408 can be or include volatile memory or non-volatile memory. Memory 408 can include database components, object code components, script components, or any other type of information structure for supporting the various activities and information structures described in the present application. According to some embodiments, memory 408 is communicably connected to processor 406 via processing circuit 404 and includes computer code for executing (e.g., by processing circuit 404 and/or processor 406) one or more processes described herein.

In some embodiments, BMS controller 366 is implemented within a single computer (e.g., one server, one housing, etc.). In various other embodiments BMS controller 366 can be distributed across multiple servers or computers (e.g., that can exist in distributed locations). Further, while FIG. 4 shows applications 422 and 426 as existing outside of BMS controller 366, in some embodiments, applications 422 and 426 can be hosted within BMS controller 366 (e.g., within memory 408).

Still referring to FIG. 4, memory 408 is shown to include an enterprise integration layer 410, an automated measurement and validation (AM&V) layer 412, a demand response (DR) layer 414, a fault detection and diagnostics (FDD) layer 416, an integrated control layer 418, and a building subsystem integration later 420. Layers 410-420 can be configured to receive inputs from building subsystems 428 and other data sources, determine optimal control actions for building subsystems 428 based on the inputs, generate control signals based on the optimal control actions, and provide the generated control signals to building subsystems 428. The following paragraphs describe some of the general functions performed by each of layers 410-420 in BMS 400.

Enterprise integration layer 410 can be configured to serve clients or local applications with information and services to support a variety of enterprise-level applications. For example, enterprise control applications 426 can be configured to provide subsystem-spanning control to a graphical user interface (GUI) or to any number of enterprise-level business applications (e.g., accounting systems, user identification systems, etc.). Enterprise control applications 426 can also or alternatively be configured to provide configuration GUIs for configuring BMS controller 366. In yet other embodiments, enterprise control applications 426 can work with layers 410-420 to optimize building performance (e.g., efficiency, energy use, comfort, or safety) based on inputs received at interface 407 and/or BMS interface 409.

Building subsystem integration layer 420 can be configured to manage communications between BMS controller 366 and building subsystems 428. For example, building subsystem integration layer 420 can receive sensor data and input signals from building subsystems 428 and provide output data and control signals to building subsystems 428. Building subsystem integration layer 420 can also be configured to manage communications between building subsystems 428. Building subsystem integration layer 420 translate communications (e.g., sensor data, input signals, output signals, etc.) across a number of multi-vendor/multi-protocol systems.

Demand response layer 414 can be configured to optimize resource usage (e.g., electricity use, natural gas use, water use, etc.) and/or the monetary cost of such resource usage in response to satisfy the demand of building 10. The optimization can be based on time-of-use prices, curtailment signals, energy availability, or other data received from utility providers, distributed energy generation systems 424, from energy storage 427 (e.g., hot TES 242, cold TES 244, etc.), or from other sources. Demand response layer 414 can receive inputs from other layers of BMS controller 366 (e.g., building subsystem integration layer 420, integrated control layer 418, etc.). The inputs received from other layers can include environmental or sensor inputs such as temperature, carbon dioxide levels, relative humidity levels, air quality sensor outputs, occupancy sensor outputs, room schedules, and the like. The inputs can also include inputs such as electrical use (e.g., expressed in kWh), thermal load measurements, pricing information, projected pricing, smoothed pricing, curtailment signals from utilities, and the like.

According to some embodiments, demand response layer 414 includes control logic for responding to the data and signals it receives. These responses can include communicating with the control algorithms in integrated control layer 418, changing control strategies, changing setpoints, or activating/deactivating building equipment or subsystems in a controlled manner. Demand response layer 414 can also include control logic configured to determine when to utilize stored energy. For example, demand response layer 414 can determine to begin using energy from energy storage 427 just prior to the beginning of a peak use hour.

In some embodiments, demand response layer 414 includes a control module configured to actively initiate control actions (e.g., automatically changing setpoints)

which minimize energy costs based on one or more inputs representative of or based on demand (e.g., price, a curtailment signal, a demand level, etc.). In some embodiments, demand response layer 414 uses equipment models to determine an optimal set of control actions. The equipment models can include, for example, thermodynamic models describing the inputs, outputs, and/or functions performed by various sets of building equipment. Equipment models can represent collections of building equipment (e.g., subplants, chiller arrays, etc.) or individual devices (e.g., individual chillers, heaters, pumps, etc.).

Demand response layer 414 can further include or draw upon one or more demand response policy definitions (e.g., databases, XML files, etc.). The policy definitions can be edited or adjusted by a user (e.g., via a graphical user interface) so that the control actions initiated in response to demand inputs can be tailored for the application of the user, desired comfort level, particular building equipment, or based on other concerns. For example, the demand response policy definitions can specify which equipment can be turned on or off in response to particular demand inputs, how long a system or piece of equipment should be turned off, what setpoints can be changed, what the allowable set point adjustment range is, how long to hold a high demand setpoint before returning to a normally scheduled setpoint, how close to approach capacity limits, which equipment modes to utilize, the energy transfer rates (e.g., the maximum rate, an alarm rate, other rate boundary information, etc.) into and out of energy storage devices (e.g., thermal storage tanks, battery banks, etc.), and when to dispatch on-site generation of energy (e.g., via fuel cells, a motor generator set, etc.).

Integrated control layer 418 can be configured to use the data input or output of building subsystem integration layer 420 and/or demand response later 414 to make control decisions. Due to the subsystem integration provided by building subsystem integration layer 420, integrated control layer 418 can integrate control activities of the subsystems 428 such that the subsystems 428 behave as a single integrated supersystem. In some embodiments, integrated control layer 418 includes control logic that uses inputs and outputs from a number of building subsystems to provide greater comfort and energy savings relative to the comfort and energy savings that separate subsystems could provide alone. For example, integrated control layer 418 can be configured to use an input from a first subsystem to make an energy-saving control decision for a second subsystem. Results of these decisions can be communicated back to building subsystem integration layer 420.

Integrated control layer 418 is shown to be logically below demand response layer 414. Integrated control layer 418 can be configured to enhance the effectiveness of demand response layer 414 by enabling building subsystems 428 and their respective control loops to be controlled in coordination with demand response layer 414. This configuration can advantageously reduce disruptive demand response behavior relative to conventional systems. For example, integrated control layer 418 can be configured to assure that a demand response-driven upward adjustment to the setpoint for chilled water temperature (or another component that directly or indirectly affects temperature) does not result in an increase in fan energy (or other energy used to cool a space) that would result in greater total building energy use than was saved at the chiller.

Integrated control layer 418 can be configured to provide feedback to demand response layer 414 so that demand response layer 414 checks that constraints (e.g., temperature, lighting levels, etc.) are properly maintained even while demanded load shedding is in progress. The constraints can also include setpoint or sensed boundaries relating to safety, equipment operating limits and performance, comfort, fire codes, electrical codes, energy codes, and the like. Integrated control layer 418 is also logically below fault detection and diagnostics layer 416 and automated measurement and validation layer 412. Integrated control layer 418 can be configured to provide calculated inputs (e.g., aggregations) to these higher levels based on outputs from more than one building subsystem.

Automated measurement and validation (AM&V) layer 412 can be configured to verify whether control strategies commanded by integrated control layer 418 or demand response layer 414 are working properly (e.g., using data aggregated by AM&V layer 412, integrated control layer 418, building subsystem integration layer 420, FDD layer 416, or otherwise). The calculations made by AM&V layer 412 can be based on building system energy models and/or equipment models for individual BMS devices or subsystems. For example, AM&V layer 412 can compare a model-predicted output with an actual output from building subsystems 428 to determine an accuracy of the model.

Fault detection and diagnostics (FDD) layer 416 can be configured to provide on-going fault detection for building subsystems 428, building subsystem devices (i.e., building equipment), and control algorithms used by demand response layer 414 and integrated control layer 418. FDD layer 416 can receive data inputs from integrated control layer 418, directly from one or more building subsystems or devices, or from another data source. FDD layer 416 can automatically diagnose and respond to detected faults. The responses to detected or diagnosed faults can include providing an alert message to a user, a maintenance scheduling system, or a control algorithm configured to attempt to repair the fault or to work-around the fault.

FDD layer 416 can be configured to output a specific identification of the faulty component or cause of the fault (e.g., loose damper linkage) using detailed subsystem inputs available at building subsystem integration layer 420. In other exemplary embodiments, FDD layer 416 is configured to provide "fault" events to integrated control layer 418 which executes control strategies and policies in response to the received fault events. According to some embodiments, FDD layer 416 (or a policy executed by an integrated control engine or business rules engine) can shut-down systems or direct control activities around faulty devices or systems to reduce energy waste, extend equipment life, or assure proper control response.

FDD layer 416 can be configured to store or access a variety of different system data stores (or data points for live data). FDD layer 416 can use some content of the data stores to identify faults at the equipment level (e.g., specific chiller, specific AHU, specific terminal unit, etc.) and other content to identify faults at component or subsystem levels. For example, building subsystems 428 can generate temporal (i.e., time-series) data indicating the performance of BMS 400 and the various components thereof. The data generated by building subsystems 428 can include measured or calculated values that exhibit statistical characteristics and provide information about how the corresponding system or process (e.g., a temperature control process, a flow control process, etc.) is performing in terms of error from its setpoint. These processes can be examined by FDD layer 416 to expose when the system begins to degrade in performance and alert a user to repair the fault before it becomes more severe.

Access Control System

Figure 5:
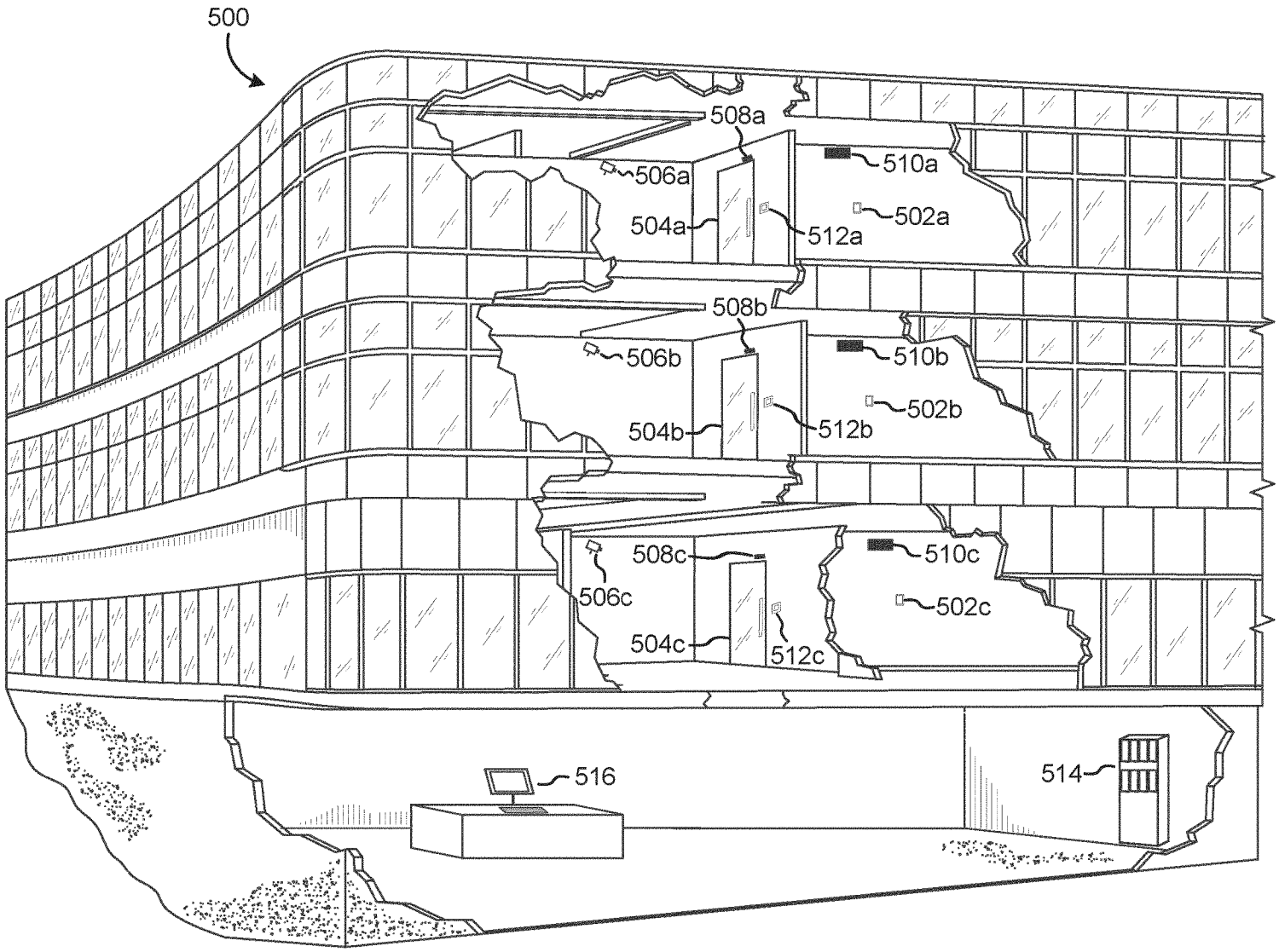
FIG. 5 is a drawing of a building equipped with an access control system (ACS), according to some embodiments.
Figure 6:
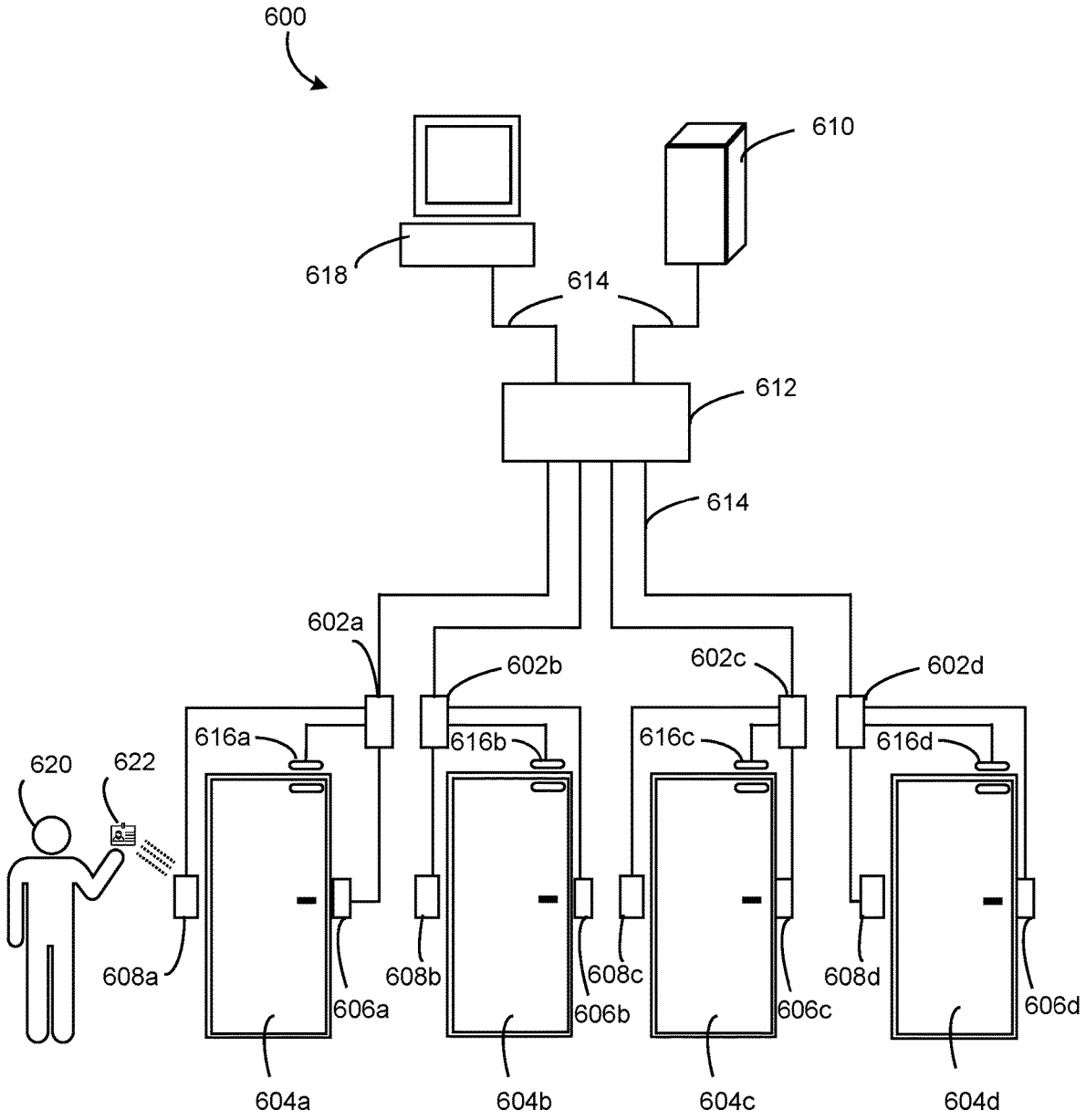
FIG. 6 is a block diagram of an ACS with a network of controlled doors, door locks, access reader modules, and door sensors, according to some embodiments.
Figure 7:
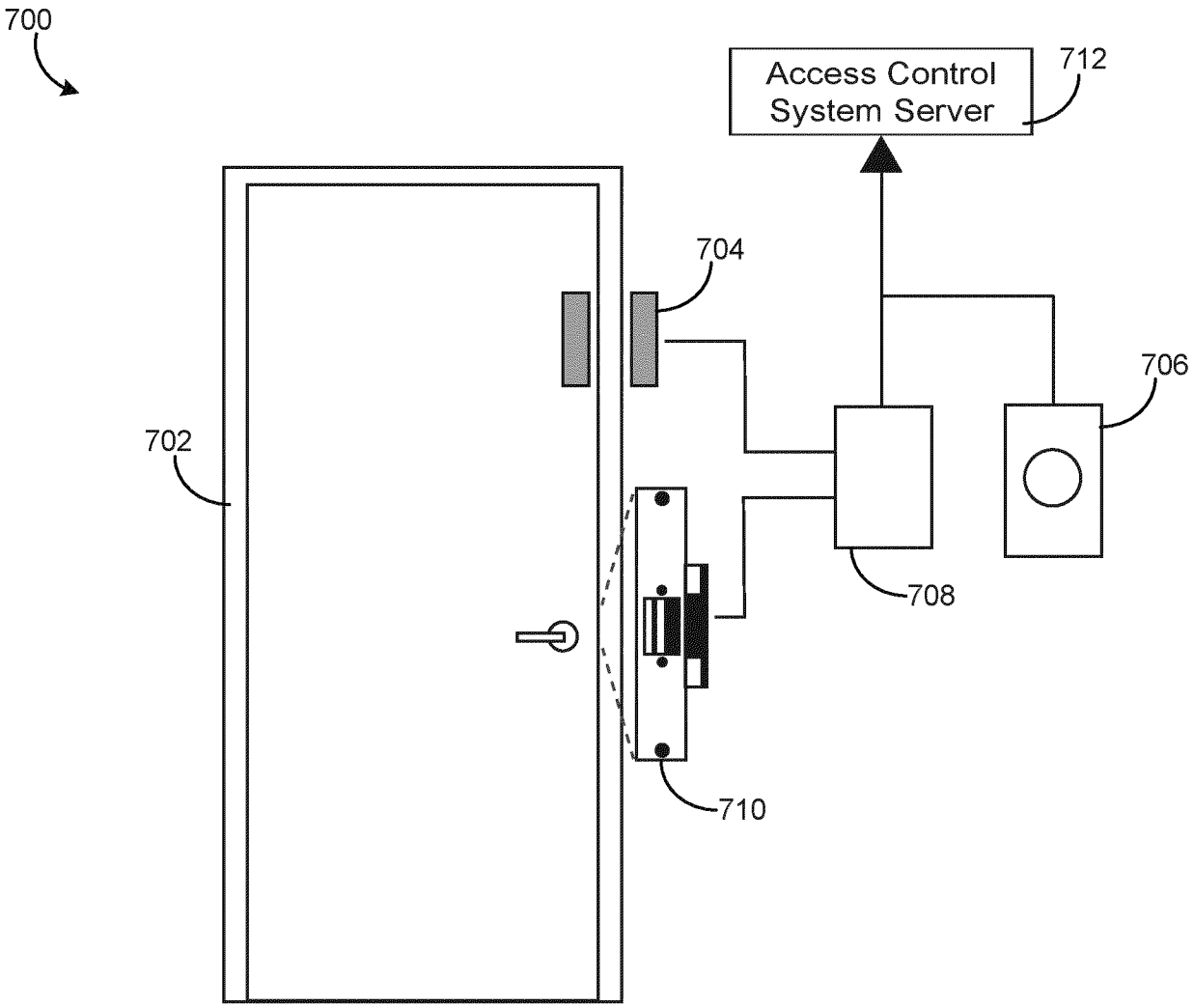
FIG. 7 is a block diagram of one example of an ACS for a monitored door, according to some embodiments.
Figure 8:
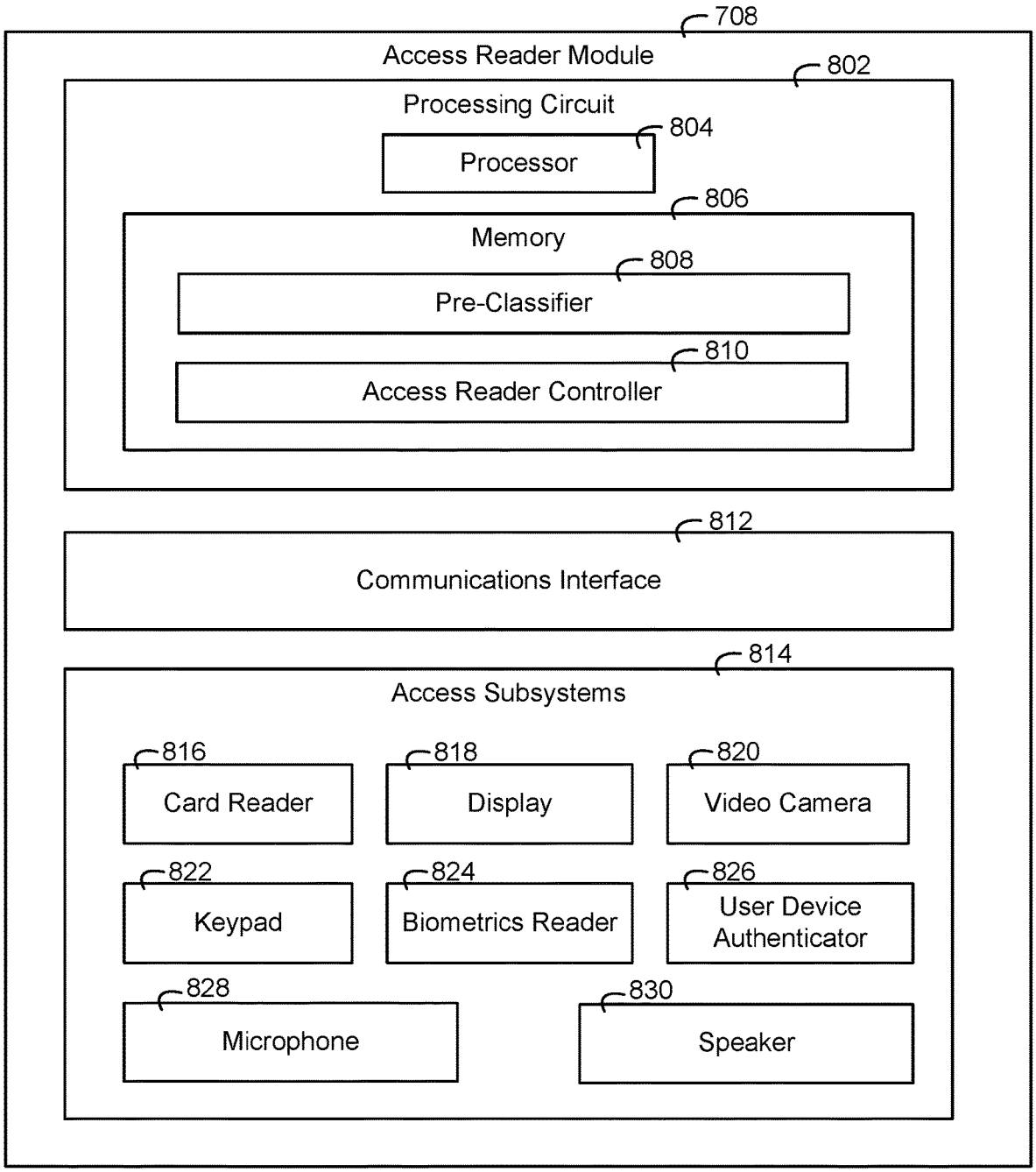
FIG. 8 is a block diagram of an access reader module for the ACS of FIG. 7, according to some embodiments.
Figure 9:
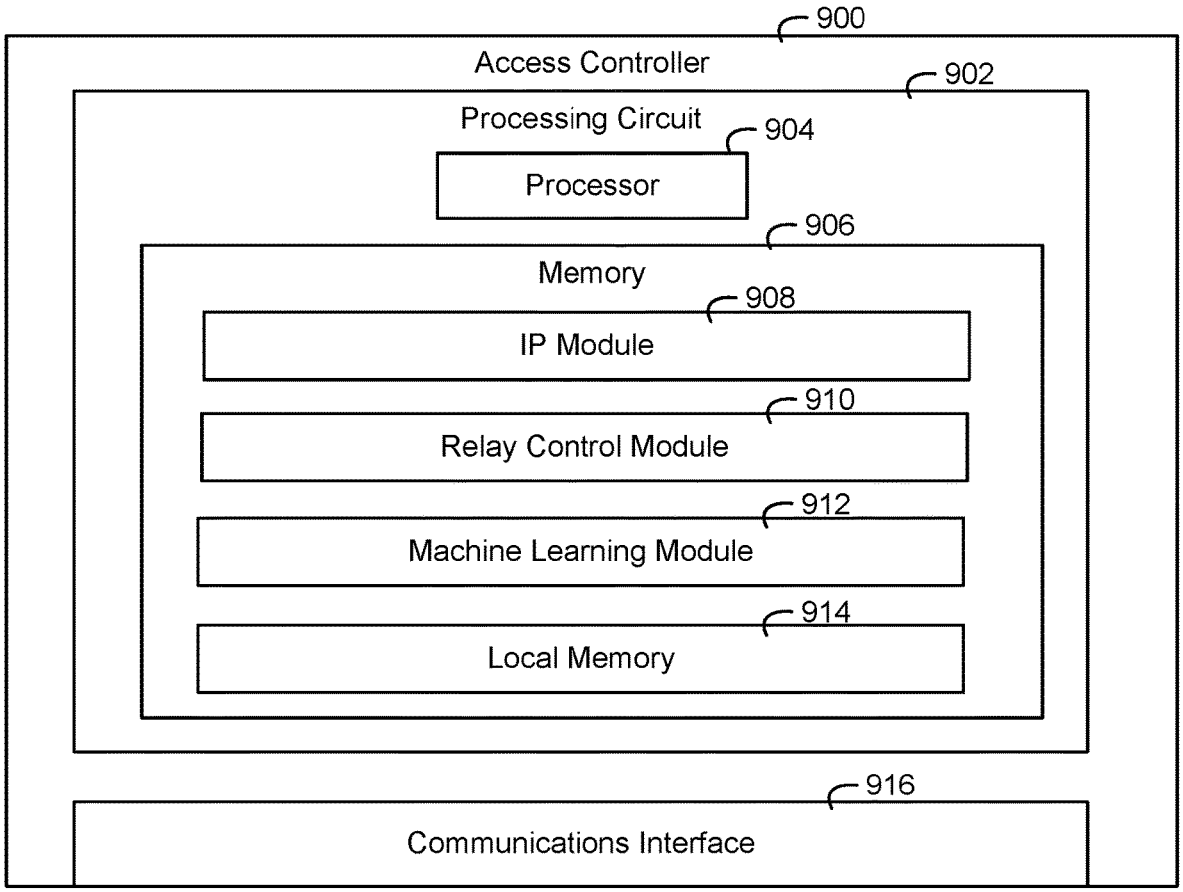
FIG. 9 is a block diagram of an access controller for the ACS of FIG. 7, according to some embodiments.
Figure 10:
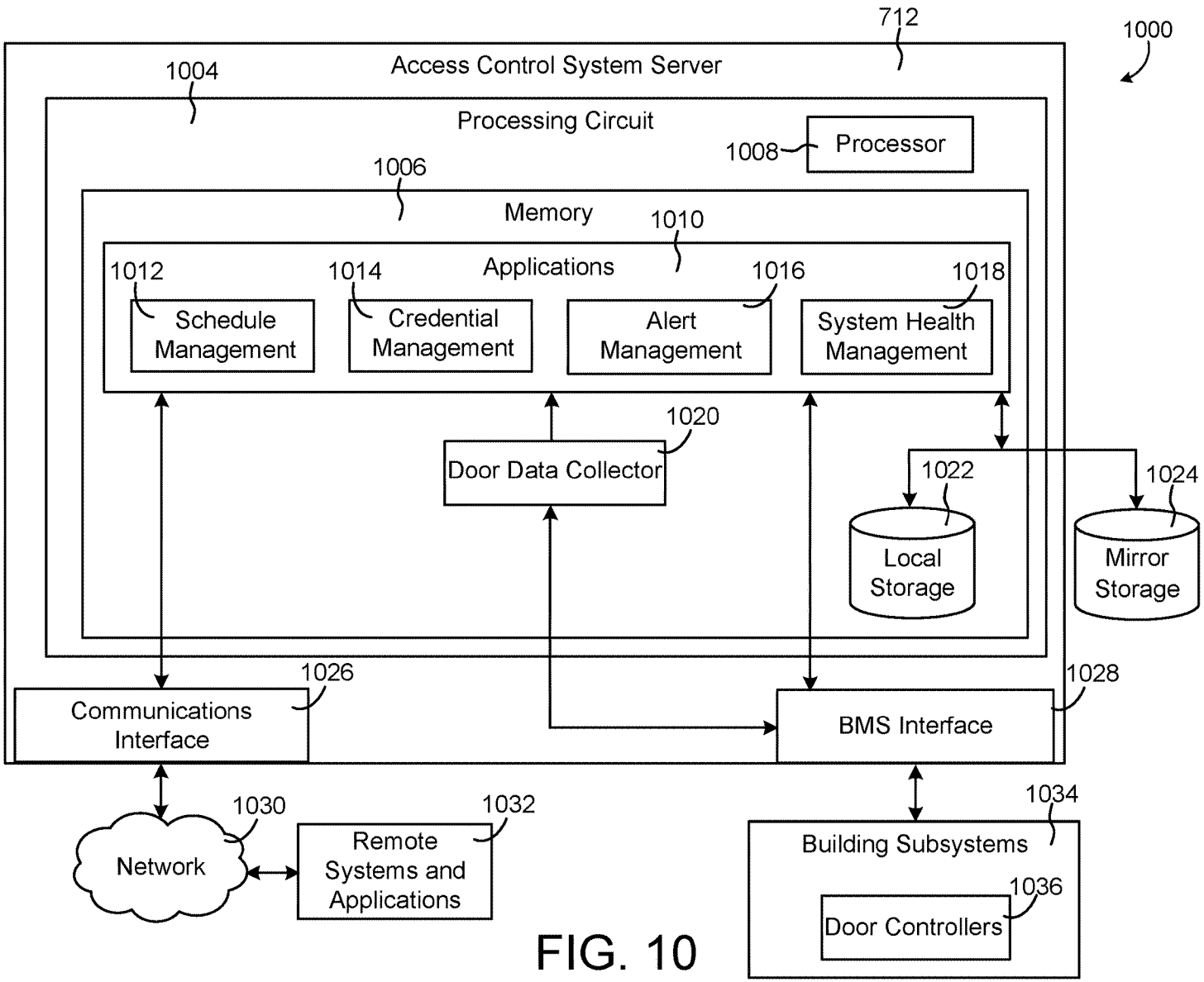
FIG. 10 is a block diagram of an ACS server which can be used in the ACS of FIG. 7, according to some embodiments.
Figure 11:
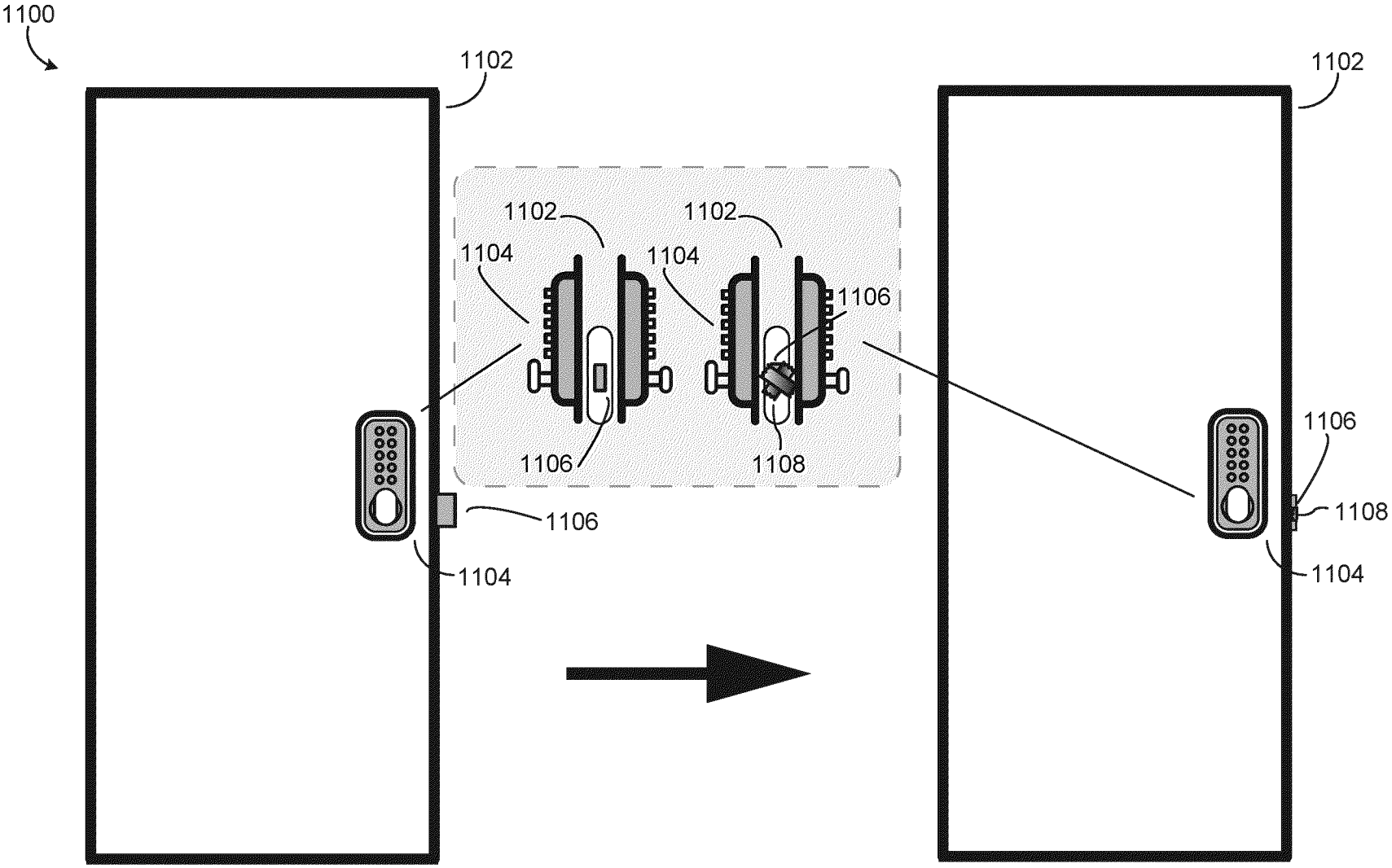
FIG. 11 is a block diagram showing an example of how a door lock might be manipulated to remain open a lock defeat device (LDD), according to some embodiments.
Figure 12:
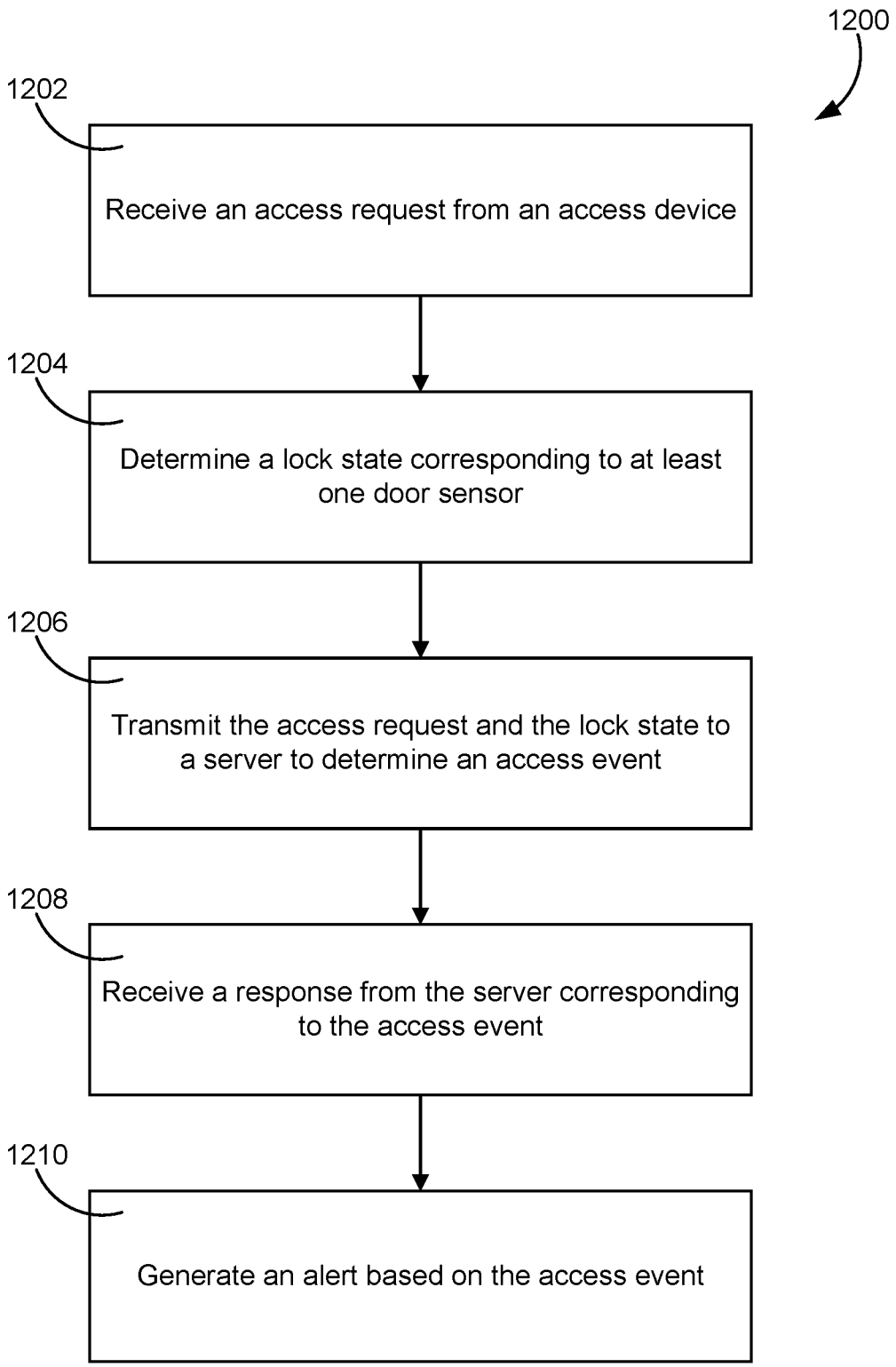
FIG. 12 is a flow diagram describing a method for monitoring access controlled doors, according to some embodiments.
Figure 13:
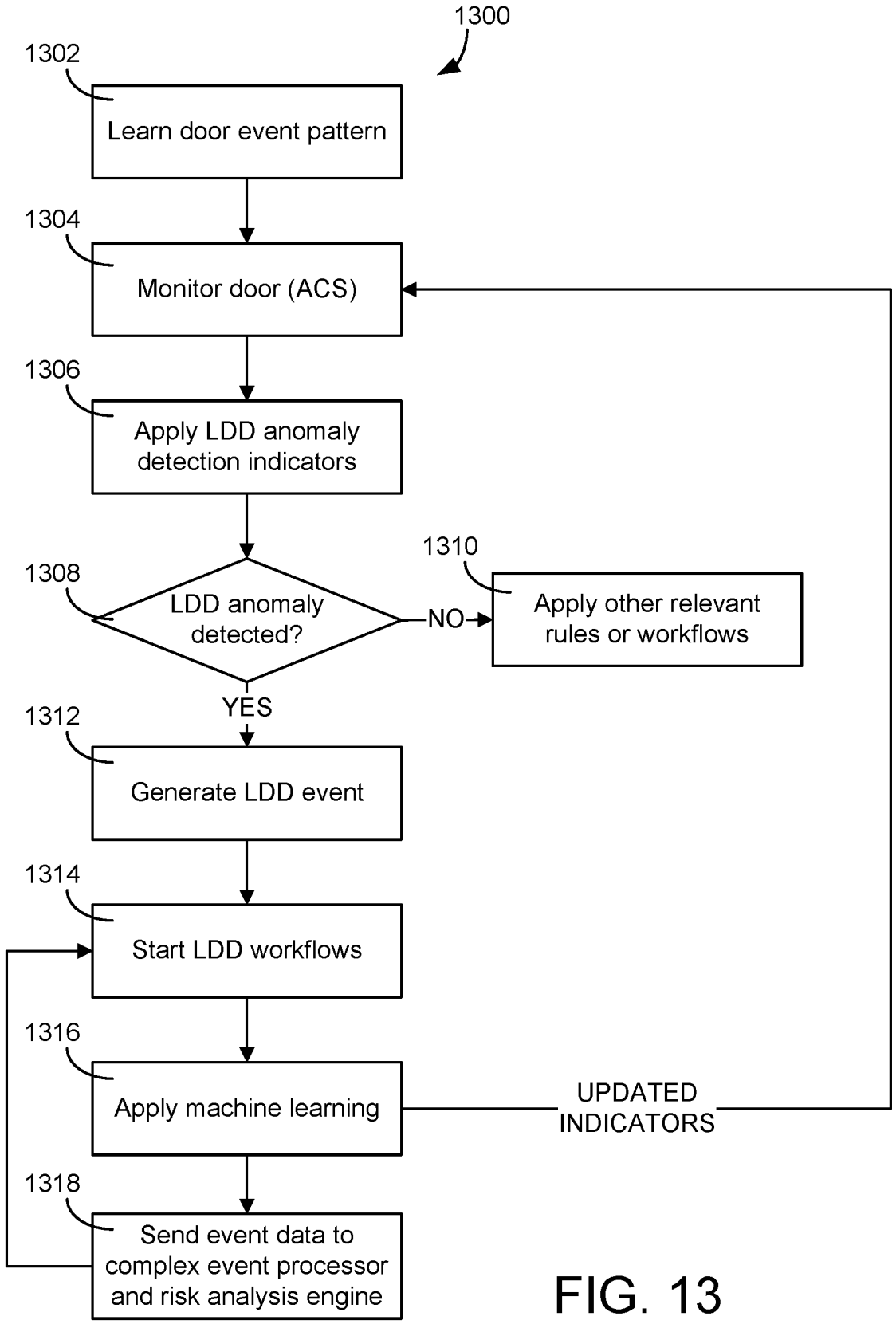
FIG. 13 is a flow diagram of a process of detecting lock defeat, according to some embodiments.
Figure 14:
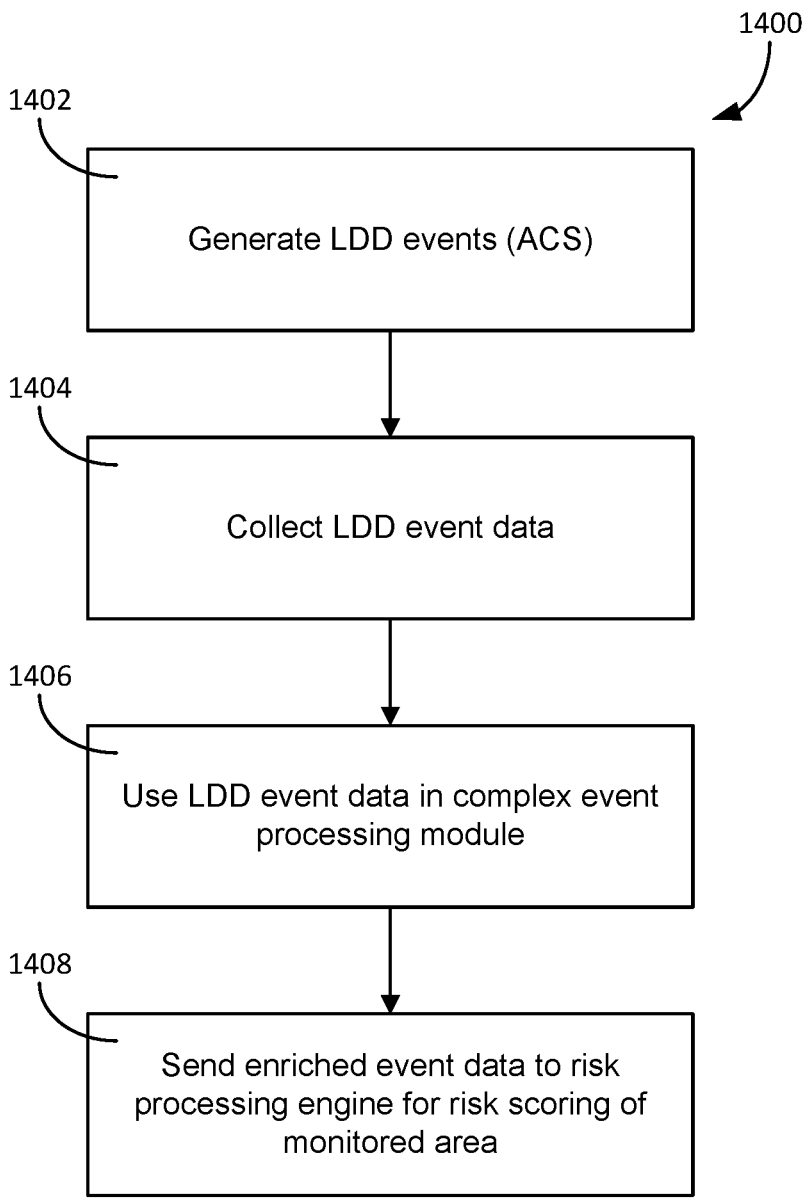
FIG. 14 is a flow diagram of risk-scoring and output presentation, according to some embodiments.

Referring now to FIGS. 5-14, several access control systems (ACS) in which the systems and methods of the present disclosure can be implemented are shown, according to some embodiments. In brief overview, FIG. 5 is a drawing of a building equipped with an access control system (ACS), according to some embodiments. FIG. 6 is a block diagram showing the main elements in an ACS, according to some embodiments. FIG. 7 is a block diagram of one example of a monitored door, according to some embodiments. FIG. 8 is a block diagram showing some of the main elements of an access reader module, according to some embodiments. FIG. 9 is a block diagram showing some of the main elements of an access controller, according to some embodiments. FIG. 10 is a block diagram of an ACS server which can be used in the building of FIG. 5, according to some embodiments. FIG. 11 is a block diagram showing an example of how a door lock might be manipulated to remain open a lock defeat device (LDD). FIG. 12 is a process flow diagram describing a method for monitoring access controlled doors, according to some embodiments. FIG. 13 is a process flow diagram describing the main steps that may take place for lock defeat device detection, according to some embodiments. FIG. 14 is a process flow diagram describing how data may be input into a risk analysis engine for risk-scoring and outputs presented to a monitoring client, according to some embodiments.

ACS Operation

Referring to access control systems (ACS) generally, a door lock may open or close in response to electrical signals from an associated access controller. The access controller can determine whether or not access should be granted to a particular user presenting their access credentials, such as an access card to an access reader module. That determination can be based on the access permissions of the user stored in the ACS database and communicated to the access controller.

ACS software may be configured to set various parameters to meet the requirements of a monitored area. Some users may have access to some areas, but may not have access to others. Access may be controlled in accordance with the time of day or week and can be restricted during public holidays. The ACS server can process access requests in accordance with such rules.

An access reader module may receive the credentials from the user and send the data to the access controller. The access controller can send the credential data to an ACS server connected through a network. The ACS server may compare the credential data with stored credential data and make a determination as to whether the credentials are valid.

The ACS server may communicate either a positive or a negative response to the access controller. The access controller can either grant the user access by causing the door lock to open or deny the user access. In some embodiments, an access reader module may be equipped with a method of communicating with the individual requesting access, such as, visually, using LEDs or screens, or audibly.

The access event may be logged on the ACS server database for monitoring and reporting. In instances when an invalid access attempt is made, such as a user with insufficient privileges requesting access using an access card, the door can remain in the locked state and the access reader module may indicate an invalid access attempt. The access controller can send data to the ACS server. The ACS server may be configured to record this access event, the credential data of the cardholder, the identification of the door, the time of the access event, the reason for denial of access, and any additional information. Table 1 below shows some examples of access events with the respective descriptions.

TABLE 1

Common Access Events

| Access Event | Description |
|---|---|
| Access Granted (AG) | A valid user with relevant privileges was granted access |
| Access Denied (AD) | A valid user without relevant privileges was denied access |
| Door Forced Open (DFO) | A controlled door was opened without the use of valid access credentials |
| Door Held Open (DHO) | A controlled door has been held or kept open for longer than a set period of time |
| Access Granted, Door Not Used (AGDNU) | Access has been granted, but the door sensors did not register a change |
| Door Malfunction | A physical and/or logical failure in some part of the ACS associated to a controlled door |
| Person of Interest (POI) or Very Important Person (VIP) | An undesired or monitored user has attempted to access the controlled door |
| Unknown Person | A user without valid access credentials has attempted to access the controlled door |
| Tailgating | Access granted for a valid user, then the user holds the controlled door open for others |
| Anti-Passback | Access granted for a valid user, then the user passes others the valid access credentials |

The data collected by the ACS may be used to generate reports and may be further processed to generate insights into door use or other security matters. Such reports or data can be displayed on a user interface for system monitors. In some embodiments, analysis of door use data may focus on types and times of event, specific doors, specific users, or other information.

The ACS may interact with a video security surveillance system. For example, if there is a DFO, the ACS may attach a video recording of the controlled door at that time and associate it with the alarm event. An ACS may use a facial recognition system (FRS) to authorize access to a controlled door.

An FRS can use unique facial features of a user, such as the shape of their face, to identify and authenticate access to a controlled area. Additional sensors may be utilized to augment the facial image data. These can include, but are not limited to, audio sensors, wearables, mobile devices, and other building management user information such as location (situation awareness), license plate recognition, and others. For example, the system can detect a mobile device of a user and may only search for the facial data of that user in the FRS database.

ACS and FRS data may create opportunities to derive actionable insights into a security environment and a risk profile of a building and could usefully be combined and correlated with other data to enhance the overall security of a monitored system. In addition, ACS and FRS data can be used to improve on existing risk management workflows and decisions.

Door Event Alarms

Certain access events may trigger alarms. DHOs and DFOs are common examples. DFO alarms may occur when the sensors associated with a door signal an unusually high level of activity or vibration to the ACS. Table 2 below shows examples of how DFOs may be triggered in a number of different ways.

TABLE 2

DFO Triggers

| Root Cause | Description | Security Risk? |
|---|---|---|
| Poor request to exit (REX) device coverage (e.g., motion detector) | DFO is triggered when a motion detector (for example, a passive infrared device) fails to detect a user walking towards the door | No |
| Actuator button (e.g., REX device) placed too far from the door | Door is unlocked when button is pushed, but resets before the user reaches the door and so a DFO is triggered when the user pushes against the door | No |
| High traffic through the door and/or tailgating | DFOs may sometimes be caused accidentally when many people are tailgating and buffeting the door, for example, through a canteen door at lunch time | No |
| Accidental | A user forgets to authenticate access using the access reader module and tries to use the door, or a user rushes to catch a door that has just closed | No |
| Wind | Wind can buffet doors, triggering the vibration sensor and causing DFOs to be raised | No |
| Air conditioning | Air conditioning can increase air pressure, leading to vibration and DFOs | No |
| Hardware/software misconfiguration/error | Vibration threshold is too sensitive (this is rare) or device is malfunctioning (this is common) | Yes |
| Lock defeat device | If a lock mechanism is taped over or otherwise jammed open, the door will close as usual but can be opened at a later point without authenticating access. | Yes |
| Intruder | An intruder attempting to gain access by forcing a door open will trigger a DFO | Yes |

The root causes of some door alarms and door-related events may be unremarkable occurrences that are of little or no concern. However, some causes can present a genuine heightened security risk, as indicated above in Table 2, in the context of DFO alarms.

Without further information about root cause, door alarms can be given equal security priority in the ACS. In a large monitored system, daily alarms may be numerous. This may lead to significant system noise and little or no means of distinguishing some genuine security threats from relatively trivial events. In addition, event data that might indicate significant security risk may not be interpreted as such by an ACS, because the configuration of the ACS does not include any means of generating an alert for such situations. Lock tampering presents a particularly serious problem for the ACS and, in current solutions, detection may require physical inspection by system monitors.

Building and ACS

Referring particularly to FIG. 5, a perspective view of a building 500 is shown, according to some embodiments. In some embodiments, building 500 may be the same or similar to building 10, as shown and described with respect to FIG. 1. Building 500 can be served by an access control system (ACS). An ACS may include a network of controlled doors 504*a*-504*c* configured to secure a monitored area. In some embodiments, controlled doors 504*a*-504*c* may be associated with devices configured to control, monitor, and manage equipment in a building.

The ACS that controls building 500 is shown to include at least REX devices 502*a*-502*c*, security cameras 506*a*-506*c*, door locks 508*a*-508*c*, access controllers 510*a*-510*c*, access reader modules 512*a*-512*c*, ACS server 514, and end-user terminal or interface 516. The ACS may also include additional elements not shown in FIG. 5 such as, specialist biometric surveillance devices and technologies (for example, cameras, audio analytics, fingerprint recognition, iris scanners, etc.). The devices may be situated anywhere in building 500 to augment the situational awareness of the ACS and a facial recognition service. Building 500 may include any number of the devices described in reference to FIG. 5.

REX devices 502*a*-502*c* can be located on the internal or non-secured side of controlled doors 504*a*-504*c* and may be configured to unlock the controlled doors 504*a*-504*c* without requiring a user to provide an access request by presenting credentials to access reader modules 512*a*-512*c*. In some embodiments, REX devices 502*a*-502*c* may be switches or motion detectors. Security cameras 506*a*-506*c* can be located on either side of controlled doors 504*a*-504*c* and may be used to monitor the controlled doors 504*a*-504*c*. Door locks 508*a*-508*c* may be electric or electromagnetic and can be configured to secure controlled doors 504*a*-504*c*. In some embodiments, door locks 508*a*-508*c* can be electric strikes, electric locks, or electromagnetic locks.

Access controllers 510*a*-510*c* may process signals from access reader modules 512*a*-512*c* and REX devices 502*a*-502*c* and cause door locks 508*a*-508*c* to open or close, based on the configuration of the ACS. Access controllers 510*a*-510*c* may also send and receive access data to ACS server 514. Access reader modules 512*a*-512*c* may be situated on the external or secured side of controlled doors 504*a*-504*c* and are configured to receive an access request from a user presenting credentials. In some embodiments, access reader modules 512*a*-512*c* can be smartcard readers, magnetic stripe readers, biometrics readers, or access keypads.

ACS server 514 may be configured to store user data, such as card holder details and their access privileges, data about persons of interest (POI) and very important persons (VIPs), access expiration dates, and other related data. ACS server 514 may also process data about access events and generate workflows and alerts. End-user terminal or interface 516 may be configured to access or display information about the ACS for building 500 and any other buildings controlled by the ACS. The ACS may manage an area of a building, a building, or groups of buildings in disparate locations and across large campuses.

Referring now to FIG. 6, a block diagram of ACS 600 is shown from a secured side of a controlled area, according to some embodiments. In some embodiments, ACS 600 may be the same or similar to the ACS that controls building 500, as shown and described with respect to FIG. 5. ACS system 600 may include a network of controlled doors 604*a*-604*d*, door locks 606*a*-606*d*, access reader modules 608*a*-608*d*, and door sensors 616*a*-616*d*. A user 620 may request access at access reader module 608*a*-608*d* by presenting credentials, shown as access card 622.

In some embodiments, controlled doors 604*a*-604*d*, door locks 606*a*-606*d*, access reader modules 608*a*-608*d*, may be the same or similar to controlled doors 504*a*-504*c*, door locks 508*a*-508*c*, and access reader modules 512*a*-512*c*, as shown and described with respect to FIG. 5. Door sensors 616*a*-616*d* may be configured to detect the lock state of controlled doors 604*a*-604*d*. The lock state can be either unlocked or locked. In some embodiments, door sensors 616*a*-616*d* can be magnetic contacts. Door locks 604*a*-604*d*, access reader modules 608*a*-608*d*, and door sensors 616*a*-616*d* may be in communication with access controllers 602*a*-602*d*.

Access controllers 602*a*-602*d* can be connected to network switch 612 that may direct signals through network connections 614 interconnecting access controllers 602*a*-602*d* to ACS server 610. ACS server 610 may be connected to end-user terminal or interface 618 through network switch 612 and network connections 614. In some embodiments, ACS server 610 and end-user terminal or interface 618 may be the same or similar to ACS server 514 and end-user terminal or interface 516, as shown and described with respect to FIG. 5.

Referring now to FIG. 7, a block diagram of an ASC 700 for controlled door 702 is shown, according to some embodiments. Door lock 710 may be connected to door sensors 704, access reader module 708, and REX device 706. Each device may be in communication with an access controller, an ACS server, and any other systems or applications forming part of an ACS network. In some embodiments, ACS 700 may be the same or similar to the ACS that controls building 500, as shown and described with respect to FIG. 5.

Controlled door 702 may be an entrance to a building or an entrance to a location within the building. The building may be the same or similar to building 500 as shown and described with respect to FIG. 5. Controlled door 702 can be configured to be secured from one side and unsecured from the other.

Door sensors 704 may be located on or near controlled door 702. Door sensors 704 can be configured to detect if controlled door 702 is open or closed. In some embodiments, door sensors 704 may be magnetic contacts.

REX device 706 can be located on the internal or non-secured side of controlled door 702 and may be configured to unlock controlled door 702 without requiring a user to provide an access request by presenting credentials to access reader module 708. In some embodiments, REX device 706 may be one or more of a switch or a motion detector.

Access reader module 708 can be located on the external or secured side of controlled door 702 and may be configured to unlock controlled door 702 by requiring the user to provide an access request by presenting credentials. In some embodiments, access reader module 708 may include a card reader.

Door lock 710 can be configured to lock or secure controlled door 702. Door lock 710 may be configured to unlock when at least one of REX device 706 or access control module 708 is operated by the user. In some embodiments, door lock 710 may be one or more of an electromagnetic lock or a locking bolt.

Access control system (ACS) server 712 may be configured to receive or send data to controlled door 702, door lock 710, door sensors 704, access reader module 708, and REX device 706 through the access controller. In some embodiments, ACS server 712 may be the same or similar to BMS server 366, as shown and described with respect to FIG. 4.

Referring now to FIG. 8, a block diagram of access reader module 708 is shown for ACS 700, according to some embodiments. Access reader module 708 is shown to include a processing circuit 802, a communications interface 812, and access subsystems 804. Processing circuit 802 is shown to include a processor 804 and memory 806. Processing circuit 802 can be communicably connected to communications interface 812 such that processing circuit 802 and the various components thereof can send and receive data via communications interface 812. In some embodiments, processing circuit 802, processor 804, memory 806, and communications interface 812 may be the same or similar to processing circuit 404, processor 406, memory 408, and communications interface 407 as shown and described with reference to FIG. 4.

Memory 806 is shown to include a pre-classifier 808 and an access reader controller 810. Pre-classifier 808 can be configured to allow the access reader module 708 to communicate via communications interface 812 with access subsystems 814, other sensors, or electronic devices, such as mobile phones, wearable technologies, license plate recognition, etc. For example, pre-classifier 808 may associate a license plate to a user or a set of users and may not search for the user or set of users in a facial recognition system (FRS) database. In this way, pre-classifier 808 may improve the speed of matching the identity of the user or set of users to stored data. The stored data may be stored in memory 806 of access reader module 708 or received from ACS server 712 via communications interface 812. For users not recognized by pre-classifier 808, access reader module 708 may use various access subsystems 814 to make a determination whether or not to grant access.

Access reader controller 810 may be configured to control access subsystems 814 and information sent and received over communications interface 812. Access reader controller 810 may collect data from access subsystems 814 and send the data to ACS server 712 via communications interface 812 and collect data from ACS server 712.

Access subsystems 814 is shown to include a card reader 816, a display 818, a video camera 820, a keypad 822, a biometrics reader 814, a user device authenticator 826, a microphone 828, and a speaker 830. In various embodiments, access subsystems 814 can include fewer, additional, or alternative subsystems. Access subsystems 814 may be operated by a user requesting access to door 702 at access reader module 708 or by access reader module communicating information to the user at door 702. Each of access subsystems 814 can include any number of devices, controllers, and connections for completing its individual functions and control activities.

Card reader 816 may be a data input device that reads and decodes data from a card-shaped storage medium, such as an access card or identification card. In some embodiments, card reader 816 can be an electronic device that can read access cards embedded with a barcode, magnetic strip, computer chip, or another storage medium. For example, a user may request access to door 712 by presenting an access card to card reader 816.

Display 818 may be configured to present information visually to the user. In some embodiments, display 818 may be a light emitting diode (LED) or a screen. For example, display 818 may inform the user that the access request to door 712 was granted, denied, or any other relevant indication. Display 818 may show that door 702 is out of order, in a state of lockdown, or any other relevant information or alarms.

Video camera 820 may be configured to record video on one or both sides of door 702. For example, door 702 may be an external door and video camera 820 records video on the external side of door 702. If a user attempts to enter door 702 without requesting access using one of access subsystems 814, access reader module 708 may send video from video camera 820 to ACS server 712. Video camera 820 can serve as a deterrent to the application of an LDD on door lock 710, and may provide visual evidence that the LDD was applied.

Keypad 822 may be configured to receive alphanumeric or other entries as an access request to door 702. In various embodiments, keypad 822 can be a physical keypad or keyboard and may be virtual, for example, a projected image. For example, the user may request access to door 702 by entering a personal identification number (PIN) or passcode to keypad 822.

Biometrics reader 824 may be configured to read biometric data from a biometric camera, fingerprint scanner, an audio analyzer, or any other biometric devices. Biometrics reader 824 may use the FRS database or a similar database containing biometric data.

User device authenticator 826 can be configured to read data contained on a user terminal device, such as a smartphone, smartwatch, or any other relevant user terminal device. In some embodiments, the user terminal device may use near-field communication (NFC) to communicate with user device authenticator 826. NFC is a set of communication protocols that enable two electronic devices, such as user device authenticator 826 and the user terminal device for example, to establish communication by bringing them within 4 cm (1.6 in) of each other.

Microphone 828 may be configured to relay intercom communications from the user and analyze audio. For example, the user may activate microphone 828 to request access from a person on the other side of the door or from a system monitor. Microphone 828 may cooperate with biometrics reader 824 to analyze the voice of the user.

Speaker 830 may be configured to relay intercom communications to the user or present information to the user in the form of sounds. For example, speaker 830 may create a siren noise if an alarm is active for door 702. Speaker 830 may be used to inform the user that the access request to door 712 was granted, denied, or any other relevant indication. Speaker 830 may communicate that door 702 is out of order, in a state of lockdown, or any other relevant information or alarms.

Referring now to FIG. 9, a block diagram of access controller 900 is shown for ACS 700, according to some embodiments. Access controller 900 is shown to include a processing circuit 902 and a communications interface 916. Processing circuit 902 is shown to include a processor 904 and memory 906. Processing circuit 902 can be communicably connected to communications interface 916 such that processing circuit 902 and the various components thereof can send and receive data via communications interface 916. In some embodiments, processing circuit 902, processor 904, memory 906, and communications interface 916 may be the same or similar to processing circuit 404, processor 406, memory 408, and communications interface 407 as shown and described with reference to FIG. 4, and access controller 900 may be the same or similar to access controller 510 as shown and described with reference to FIG. 5. In some embodiments, access reader module 708 may perform all or some of the functions of access controller 900 described herein.

Memory 906 is shown to include an internet protocol (IP) module 908, relay control module 910, machine learning module 912, and local memory 914. IP module may be configured to send and receive data from devices on the ACS network, such as access reader module 708 and ACS server 712. Data may be sent or received from IP module 908 via communications interface 916 using WiFi, Ethernet, or any other appropriate method of data transfer over a network.

Relay control module 910 may be configured to send and receive signals from door sensors 704, door lock 710, access reader module 708, REX device 706, ACS server 712, and any other connected systems. The signals received by relay control module 910 may indicate an access request at access reader module 708, a request to exit at REX device 706, and a state of door 702, such as locked, unlocked, open, closed, jammed, etc. For example, relay control module may receive an indication of an access granted event from ACS server 712 via communications interface 916 and send a signal to door lock 710 indicating to unlock door 702.

Machine learning module 912 may be configured use machine learning techniques for establishing normal event pattern data for door 702, from which LDD anomalies can be distinguished. Furthermore any computing device described herein can be configured to perform the machine learning techniques. The machine learning techniques used may include the Isolation Forest Algorithm, the Local Outlier Factor, and any other appropriate technique of pattern or anomaly analysis.

Local memory 914 may be configured to store data within memory 906 of access controller 900. The data saved may be normal door event patterns for door 702, credential data for users, indicators for LDD detection, and any other relevant information. For example, local memory 914 may save information required by pre-classifier 808 as shown and described in FIG. 8. Pre-classifier 808 can used saved data to improve the speed of identifying a user.

Referring now to FIG. 10, a block diagram 1000 of ACS server 712 is shown, according to some embodiments. In some embodiments, ACS server 712 may be the same or similar to BMS server 366, as shown and described with respect to FIG. 4. In some embodiments, ACS server 712 may perform all or some of the functions of access controller 900, and access controller 900 may perform all or some of the functions of ACS server 712.

ACS server 712 is shown to include processing circuit 1004, building management system (BMS) interface 1028, and communications interface 1026. Processing circuit 902 is shown to include a processor 1008 and memory 1006. Processing circuit 1004 can be communicably connected to communications interface 1026 such that processing circuit 1004 and the various components thereof can send and receive data via communications interface 1004. Communications interface 1026 may be connected through a communications link to a network 1030, which may be connected to remote systems and applications 1032. Processing circuit 1004, processor 1008, memory 1006, BMS interface 1028, communications interface 1026, network 1030, and remote systems and applications 1032 may be the same or similar to processing circuit 404, processor 406, memory 408, BMS interface 409, communications interface 407, network 446, and remote systems and applications 444 as shown and described with reference to FIG. 4.

Memory 1006 can include various applications 1010, such as schedule management 1012, credential management 1014, alert management 1016, and system health management 1018. Memory 1006 may also include a door data collector 1020, and local storage 1022. In some embodiments, local storage 1022 may be an array of data storage drives. Local storage 1022 can be configured to store data for each of applications 1010. For example, local storage can save schedule data for schedule management 1012, credential data for credential management 1014, alert data for alert management 1016, and system health data for system health management 1018. Local storage 1024 may be linked to mirror storage 1024. Mirror storage 1024 can act as a backup for local storage 1022 and may be either in the same location or a different location then local storage 1022. Mirror storage 1024 can be updated at any frequency, such as constantly, every minute, every hour, etc.

BMS interface 1028 may be configured to send and receive data from applications 1010, door data collector 1020, and building subsystems 1034, including door controllers 1036. In some embodiments, door controllers 1036 may be the same or similar to access controller 900 as shown and described with reference to FIG. 9. Data from door controllers 1036 is collected by door data collector 1020 and sent to the appropriate application of applications 1010. For example, door data collector 1020 may receive an indication of an access request at access reader module 708, a request to exit at REX device 706, and a state of door 702, such as locked, unlocked, open, closed, jammed, etc.

Schedule management 1012 may control any schedules for an ACS. For example, schedule management 1012 may lock or unlock specific doors at specific times, may inform system monitors of scheduled maintenance for any of the components of the ACS, or any other relevant schedules. In some embodiments, schedule management 1012 may control schedules for other building subsystems 428 as shown and described with reference to FIG. 4. For example, schedule management 1012 may create or update a schedule for door 702 based on information collected by and received from door data collector 1020 using techniques of machine learning. The schedule may indicate a normal use pattern for door 702 that can be used in detecting anomalies that may indicate an LDD.

Credential management 1014 may compare credentials of a user submitting an access request at a door to credentials stored in local storage 1022. For example, using credential management 1014, ACS server 712 can make a determination to grant access or deny access to a user requesting access at access reader module 708 for door 702 based on if the credentials are valid and if the user has access to door 702. Credential management 1014 may also tag a user as VIP or POI, as indicated by the system monitor.

Alert management 1016 can be configured to activate alarms and store a history of alerts and alarms for the ACS. For example, if door data collector 1020 provides alert management 1016 an indication that door 702 was forced open, alert management 1016 may activate an alarm indicating that door 702 was forced open. Alert management 1016 may use techniques of machine learning to update or generate new indicators for LDD detection based on the alert and alarm history for door 702, for example.

System health management 1018 may be configured to generate and update risk scores for assets within the ACS. For example, if an alert or alarms occurs at door 702, a risk score for door 702 and any assets secured by door 702 is generated or updated. Risk scoring may assist system monitors in identifying and prioritizing genuine security concerns, thereby improving the overall security profile of the ACS and monitored assets. System health management 1018 may also monitor the physical health or condition of devices of the ACS. For example, if door lock 710 begins to malfunction frequently, system health management 1018 may inform a system monitor or may communicate to alert management 1016 to create an alert for door lock 710.

Lock Defeat Device Detection and Risk Scoring

Referring now to FIG. 11, a block diagram of a door lock that is being manipulated to remain open using tape as an LDD is shown, according to some embodiments. LDD scenario 1100 may occur when a door lock is tampered with, for example, taped or jammed open, so that the door can be opened without authentication at a later point in time.

Door 1102 is shown to include an access reader module 1104. In some embodiments, access reader module 1104 can be a keypad. Access reader module 1104 may be the same or similar to access reader module 708 as described with reference to FIG. 8.

Door 1102 on the left shows a door lock 1106 in the locked position. In some embodiments, door lock 1106 may be one or more of an electromagnetic lock or a locking bolt. A closer side-view of door lock 1106 shows, on the left, door lock 1106 untampered with, and, on the right, door lock 1106 fixed in the unlocked position by LDD 1108. In some embodiments, LDD 1108 may be tape.

In some scenarios, LDD 1108 may be applied by door 1102 users, such as employees, maintenance workers, construction crews, or other frequent users by taping or jamming door lock 1106 open to facilitate easier access for what they deem to be a legitimate purpose. In other scenarios, LDD 1108 may be applied by intruders by taping or jamming door lock 1106 open so that they can gain unauthorized access at a later time.

Still referring to FIG. 11, LDD scenarios, similar to LDD 1108, may create a heightened security risk. A need exists to improve the overall security of an ACS by providing a means of automatically and accurately identifying various LDD scenarios. Once identified, such events may then be flagged and prioritized for appropriate further action. Such events may also provide a potentially useful source of risk analysis data and other insights into the monitored environment.

Referring now to FIG. 12, a flow diagram of a process 1200 of monitoring access controlled doors is shown, according to some embodiments. In embodiments, access reader module 708 as described with reference to FIG. 7, access controller 900 as described with reference to FIG. 9, and/or access control system (ACS) server 712 as described with reference to FIG. 10 are configured to perform some or all of the steps of process 1200. Furthermore any computing device described herein can be configured to perform the process 1200.

Process 1200 is shown to include receiving an access request from an access device (step 1202). For example, in step 1202, access module 708 can receive an access request from an access device. The access device can be any type of access device, e.g., card reader 816, biometrics 804, keypad 822, and/or any other access device as described with reference to FIG. 8 or elsewhere herein. The access request can be a request to open and/or unlock a particular door, e.g., door 702. The access request can include personal identifying information (PII), for example, card identifier number for an ID card, fingerprint data, eye data, voice biometrics data, etc. The information of the access request can be associated with a particular user and may be linked to permission to access door 702, clearance level (e.g., access to certain groups of doors), etc.

Process 1200 is shown to include determining a lock state corresponding to at least one door sensor (step 1204). For example, access module 708 can determine whether lock 710 is locked or unlocked via sensor 704. In some embodiments, sensor 704 senses the state of lock 710 directly, e.g., my determining the position of a locking device of lock 710. However, in some embodiments, sensor 704 senses whether lock 710 is locked or unlocked indirectly, i.e., by determining whether door 702 is open or closed.

Process 1200 is shown to include transmitting the access request and the lock state to a server to determine an access event (step 1206). For example, the access request can be the access request received in step 1202 and the lock state can be the lock state determined in step 1204. As an example, access module 708 can transmit the access request and the lock state to server 712. In some embodiments, access module 708 can transmit the data (i.e., the access request, the lock state, and/or any other data) to server 712 via a network. For example, the network can be and/or can be similar to network 446 as described with reference to FIG. 4, network connections 614, and/or network switch 612. In this regard, access module 708 can implement various communication protocols, for example, Internet Protocols.

Process 1200 is shown to include receiving a response from the server corresponding to the access event (step 1208). For example, access module 708 can receive the access event from server 712. The response corresponding to the access event can indicate whether the door has been tampered with or is being tampered with. Process 1200 is shown to include generating an alert based on the access event (step 1210). For example, server 712 can generate an alert based on the response server 712 generates in step 1208. Server 712 can present an indication of an alarm to a user interface, cause an emergency siren or lock down system to operate, etc. Furthermore, access module 708 can locally generate an alert. For example, access module 708 can flash or operate local door emergency lights, local sirens, etc. In response to generating the alert, access module 708 can cause lock 710 to remain in a locked state or cause lock 710 to enter a locked state if it is in an unlocked state.

Referring now to FIG. 13, a flow diagram of a process 1300 describing the main steps that may take place for lock defeat device detection is shown, according to some embodiments. LDDs may create a heightened security risk. A need exists to improve the overall security of an ACS by providing a means of automatically and accurately identifying various LDD scenarios. Once identified, such events may then be flagged and prioritized for appropriate further action. Such events may also provide a potentially useful source of risk analysis data and other insights into the monitored environment. In embodiments, access reader module 708 as described with reference to FIG. 7, access controller 900 as described with reference to FIG. 9, and/or access control system (ACS) server 712 as described with reference to FIG. 10 are configured to perform some or all of the steps of process 1300. Furthermore any computing device described herein can be configured to perform the process 1300.

Process 1300 is shown to include learning door event patterns (step 1302). For example, ACS server 712 may learn normal use patterns for door 702 or any other doors in the ACS. A system monitor may also provide the normal use pattern to ACS server 712. The normal use pattern for door 702 may include times of access and information of users that access door 702 regularly.

Process 1300 is shown to include monitoring door (step 1304). For example, ACS server 712 may monitor the usage of door 702 and compare the usage of door 702 to the normal use pattern of door 702 from step 1302. This allows ACS server 712 to be able to detect any deviations of the usage of door 702 from the normal use pattern of door 702.

Process 1300 is shown to include applying lock-defeat device (LDD) anomaly detection indicators (step 1306). For example, ACS server 712 may use LDD indication rules provided by the system monitor to determine whether an anomaly in the usage of door 702, from step 1304, compared to the normal use pattern of door 702, from step 1302, might be an indication of an LDD on door 702.

Process 1300 is shown to include detecting an LDD anomaly (step 1308). For example, when ACS server 712 applies LDD anomaly detection indicators from step 1306, if the anomaly is not identified as an indication of an LDD, ACS server 712 applies other relevant rules or workflows (step 1310). The other relevant rules or workflows may include ACS server 712 causing an appropriate alarm to be, at least one of, created, suppressed, or escalated.

Process 1300 is shown to include generating LDD events (step 1312). For example, when ACS server 712 applies LDD anomaly detection indicators from step 1306, if the anomaly is identified as an indication of an LDD, ACS server generates an appropriate LDD event (step 1312). The LDD event corresponds to an appropriate workflow to follow in response to an indication of the LDD event.

Process 1300 is shown to include starting LDD workflows (step 1314). For example, the ACS server 712 may cause an appropriate alarm to be, at least one of, created, suppressed, or escalated. The system monitor may be notified of the LDD event, and the LDD event data may be collected by ACS server 712 in local storage 1022, in mirror storage 1024, over network 1030, or by any other appropriate method.

Process 1300 is shown to include applying machine learning (step 1316). For example, ACS server 712 may be configured to apply machine learning techniques, such as the Isolation Forest Algorithm, the Local Outlier Factor, and any other appropriate technique of pattern or anomaly analysis. Machine learning can be used to generate new or update the current LDD indicators applied in process 1300 in step 1306.

Process 1300 is shown to include sending event data to complex event processor and risk analysis engine (step 1318). For example, if an LDD event is indicated at door 702, the complex event processor and risk analysis engine would generate or update a risk score for door 702 and any assets secured by door 702. Risk scoring in step 1318 may assist system monitors in identifying and prioritizing genuine security concerns, thereby improving the overall security profile of the ACS and monitored assets.

Referring now to FIG. 14, a flow diagram of a process 1400 describing how data may be input into a risk analysis engine for risk-scoring and outputs presented to a monitoring client is shown, according to some embodiments. Risk scoring in may assist system monitors in identifying and prioritizing genuine security concerns, thereby improving the overall security profile of the ACS and monitored assets. In embodiments, access reader module 708 as described with reference to FIG. 7, access controller 900 as described with reference to FIG. 9, and/or access control system (ACS) server 712 as described with reference to FIG. 10 are configured to perform some or all of the steps of process 1400. Furthermore any computing device described herein can be configured to perform the process 1400.

Process 1400 is shown to include generating LDD events (step 1402). In some embodiments, step 1402 may be the same or similar to step 1312 as shown and described with reference to FIG. 13. For example, when ACS server 712 detects an indication of an LDD at doo 702, ACS server generates an appropriate LDD event. The LDD event corresponds to an appropriate workflow to follow in response to an indication of the LDD event.

Process 1400 is shown to include collecting LDD event data (1404). For example, ACS server 712 may collect data that may include date, time, location, user credentials, security camera video, etc. corresponding to the LDD event from step 1402 at door 702. The LDD event data may be collected by ACS server 712 in local storage 1022, in mirror storage 1024, over network 1030, or by any other appropriate method.

Process 1400 is shown to include using LDD event data in complex event processing module (step 1406) and sending enriched event data sent to risk processing engine for risk scoring of monitored area (step 1408). For example, if an LDD event is indicated at door 702, the complex event processor and risk analysis engine would generate or update a risk score for door 702 and any assets secured by door 702. Risk scoring may assist system monitors in identifying and prioritizing genuine security concerns, thereby improving the overall security profile of the ACS and monitored assets.

Lock Defeat Device Indicators and Workflows

Figure 15:
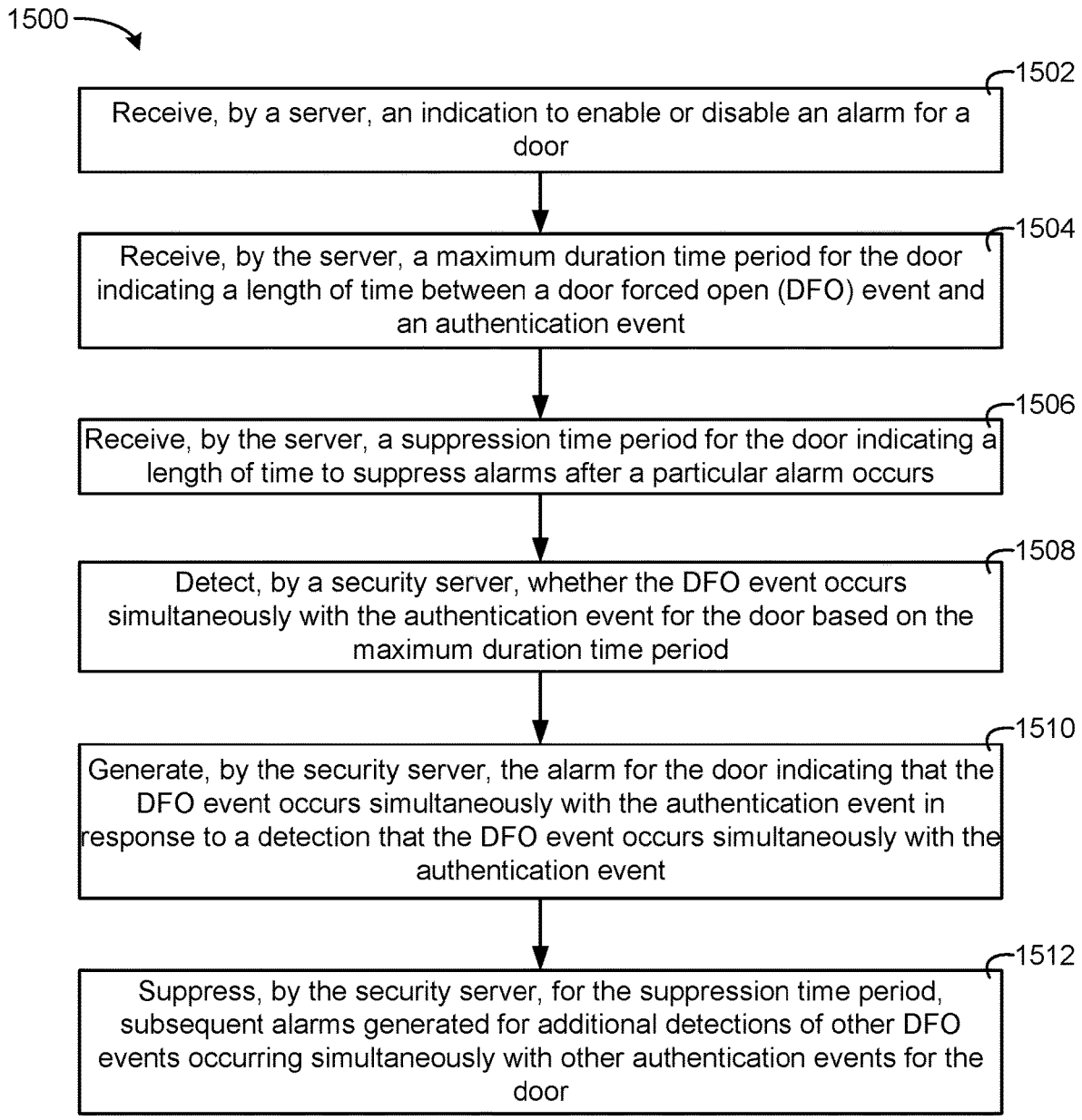
FIG. 15 is a flow diagram of operations for detecting and generating an alarm indicating that a door forced open (DFO) event occurs simultaneously with an authentication event at a door is shown, according to some embodiments.
Figure 16:
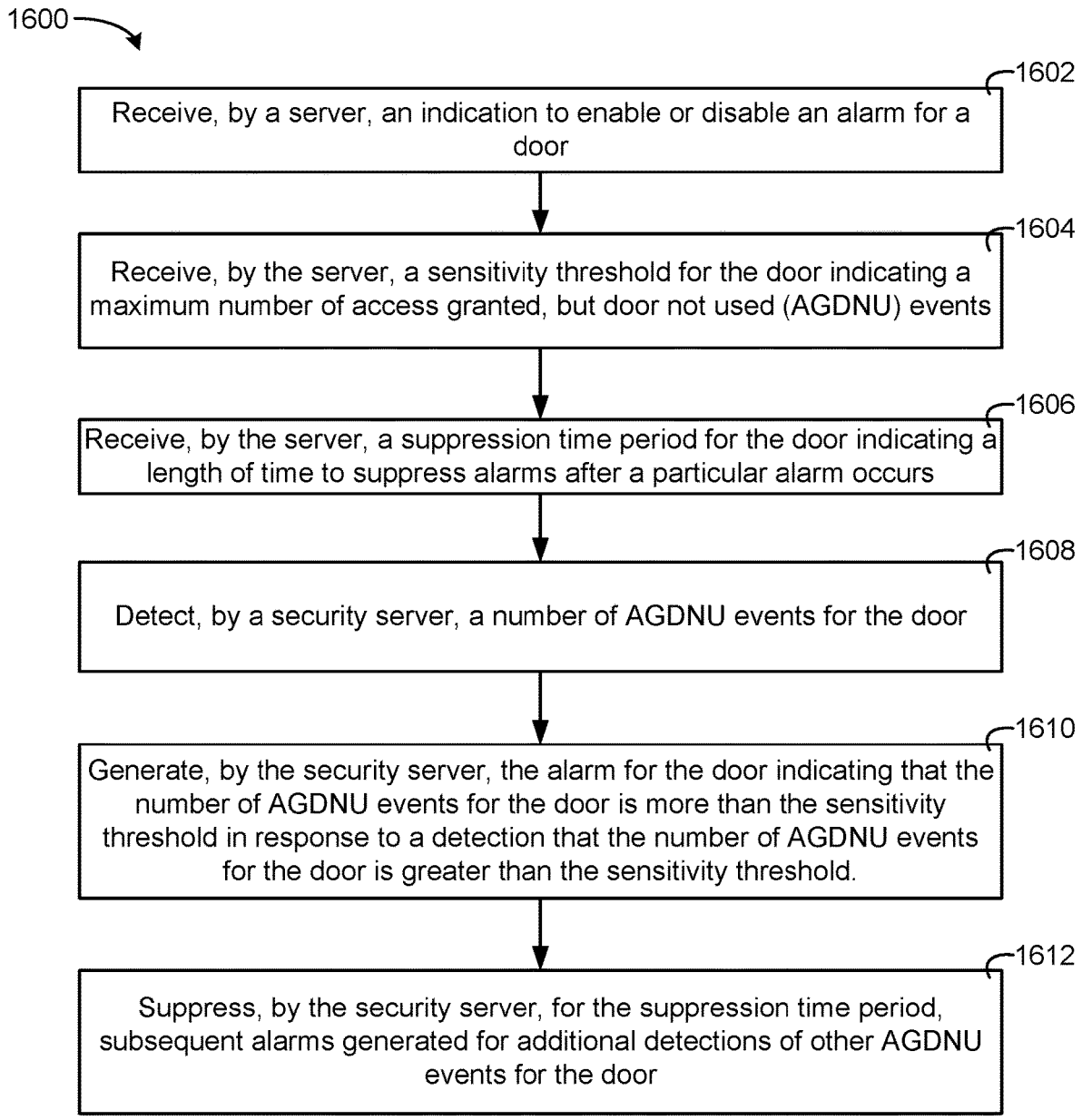
FIG. 16 is a flow diagram of operations of generating an alarm indicating that a number of access granted, but door not used (AGDNU) events for a door is more than a sensitivity threshold is shown, according to some embodiments.
Figure 17:
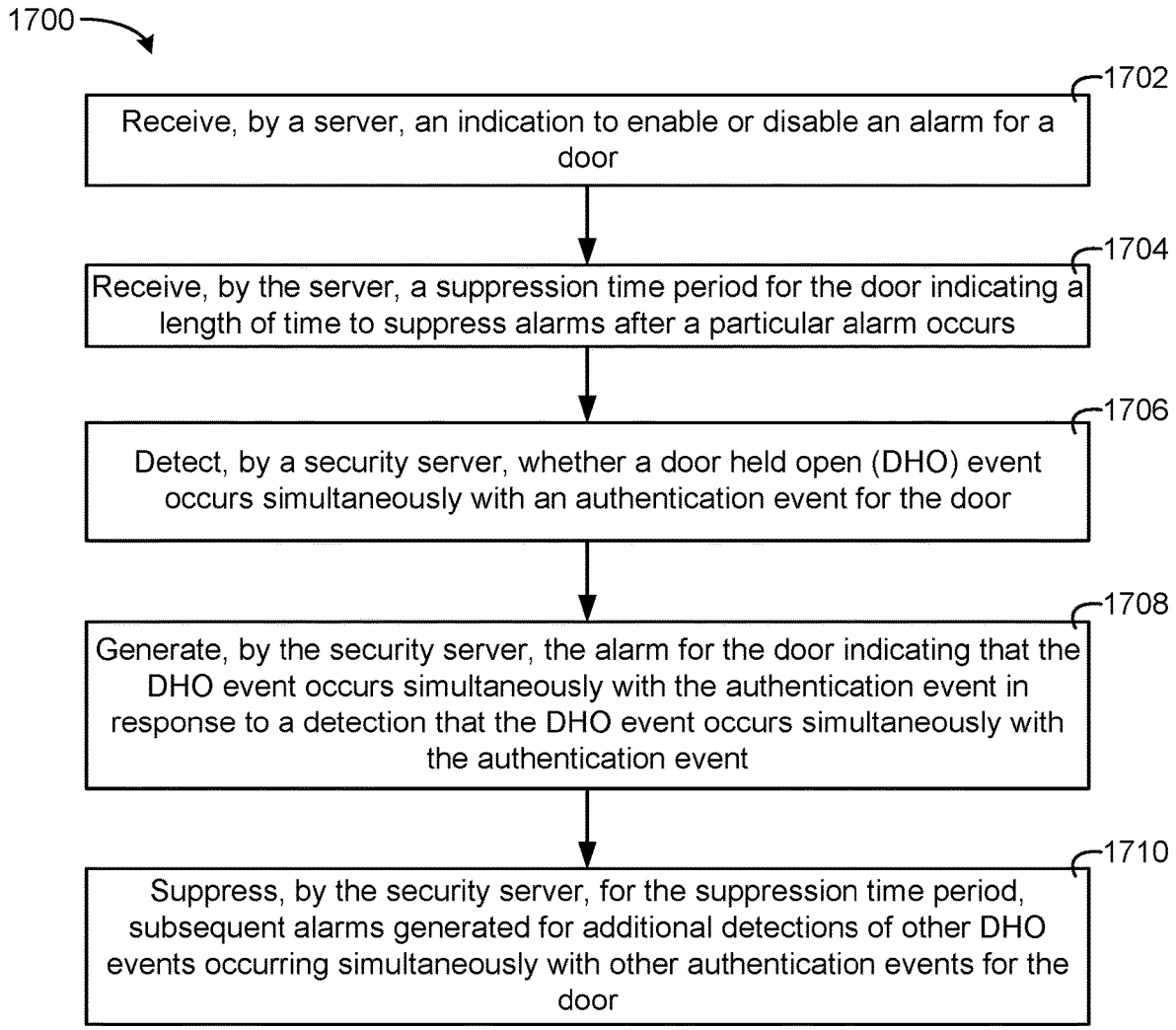
FIG. 17 is a flow diagram of operations for detecting and generating an alarm indicating that a door held open (DHO) event occurs simultaneously with an authentication event at a door is shown, according to some embodiments.

Referring now to FIGS. 15-17, a possible set of indicators used to identify lock defeat device (LDD) scenarios and possible automated workflows described may be used individually, or combined in an ensemble approach, to identify LDDs and may be used with machine learning techniques for establishing normal event pattern data, from which LDD anomalies can be distinguished. In embodiments, access reader module 708 as described with reference to FIG. 7, access controller 900 as described with reference to FIG. 9, and/or access control system (ACS) server 712 as described with reference to FIG. 10 are configured to perform some or all of the steps of the machine learning techniques for establishing normal event pattern data, from which LDD anomalies can be distinguished. Furthermore any computing device described herein can be configured to perform the machine learning techniques. The machine learning techniques used may include the Isolation Forest Algorithm, the Local Outlier Factor, and any other appropriate technique of pattern or anomaly analysis.

Referring now to FIG. 15, a flow diagram of a process 1500 describing a series of steps for detecting and generating an alarm indicating that a door forced open (DFO) event occurs simultaneously with an authentication event at a door is shown, according to some embodiments. In embodiments, access reader module 708 as described with reference to FIG. 7, access controller 900 as described with reference to FIG. 9, and/or access control system (ACS) server 712 as described with reference to FIG. 10 are configured to perform some or all of the steps of process 1500. Furthermore any computing device described herein can be configured to perform the process 1500.

Process 1500 is shown to include receiving, by a server, an indication to enable or disable an alarm for a door (step 1502). For example, ACS server 712 may be configured to enable or disable the alarm at door 702. In some embodiments, the alarm enabled or disabled at door 702 is the alarm generated by process 1500 or all alarms together for door 702. In some embodiments, the alarm may be created or disabled at only ACS server 712, with no indication of an alarm at door 702.

Process 1500 is shown to include receiving, by the server, a maximum duration time period for the door indicating a length of time between a door forced open (DFO) event and a authentication event (step 1504). For example, ACS server 712 may be configured to set the maximum duration time period for door 702 indicating a length of time between the DFO event and an authentication event. This configurable time period can be shortened or lengthened by a system monitor or by the ACS server 712.

Process 1500 is shown to include receiving, by the server, a suppression time period for the door indicating a length of time to suppress alarms after a particular alarm occurs (step 1506). For example, ACS server 712 may be configured to set the suppression time period for door 702 indicating a length of time to suppress alarms after a particular alarm occurs. This configurable time period can be shortened or lengthened by a system monitor or by the ACS server 712. In some embodiments, the suppression time period for door 702 may be used to suppress the alarms generated by process 1500 or all alarms together for door 702.

Process 1500 is shown to include detecting, by a security server, whether the DFO event occurs simultaneously with the authentication event for the door based on the maximum duration time period (step 1508). For example, ACS server 712 may receive an indication of a DFO event at door 702 and an access request from access module 708 resulting in an authentication event at the same time or within the maximum duration time period for door 702, set in step 1504, indicating a length of time between the DFO event and the authentication event.

Process 1500 is shown to include generating, by the security server, the alarm for the door indicating that the DFO event occurs simultaneously with the authentication event in response to a detection that the DFO event occurs simultaneously with the authentication event (step 1510). For example, if the DFO event and the authentication event from step 1508 occur within the maximum duration time period for door 702, ACS server 712 may generate an alarm at door 702 and/or at ACS server 712 indicating that the DFO event occurs simultaneously with the authentication event at door 702.

Still referring to FIG. 15, an LDD may be indicated when a DFO event occurs simultaneously or almost simultaneously with an authentication event, such as an access granted (AG) event or an access granted, but door not used (AGDNU) event. This can be detected in step 1508 of process 1500 and may occur when ACS server 712 authenticates access at door 702, but door lock 710 has been jammed. The unlocking mechanism of door lock 710 can try to activate and may fail or malfunction, with the operation being compromised by the LDD. Signals from door sensors 704 or door lock 710 may be sent to ACS server 712. ACS server 712 may generate the DFO event occurs simultaneously with the authentication event alarm, such as in step 1510. In some cases, the event description may be different, the signal data may be similar, and the relevant event type may replace the DFO event for the purposes of this approach.

Process 1500 is shown to include suppressing, by the security server, for the suppression time period, subsequent alarms generated for additional detections of other DFO events occurring simultaneously with other authentication events for the door (step 1512). For example, ACS server 712 my suppress alarms for the suppression time period, set in step 1506, for door 702 to prevent door 702 from triggering repeating alarms for the same DFO occurring simultaneously with authentication events alert. Suppressing alarms may allow system monitors to better identify and prioritize genuine security concerns.

Referring now to FIG. 16, a flow diagram of a process 1600 describing a series of steps for detecting and generating an alarm indicating that a number of access granted, but door not used (AGDNU) events for a door is more than a sensitivity threshold is shown, according to some embodiments. In embodiments, access reader module 708 as described with reference to FIG. 7, access controller 900 as described with reference to FIG. 9, and/or access control system (ACS) server 712 as described with reference to FIG. 10 are configured to perform some or all of the steps of process 1600. Furthermore any computing device described herein can be configured to perform the process 1600.

Process 1600 is shown to include receiving, by a server, an indication to enable or disable an alarm for a door (step 1602). For example, ACS server 712 may be configured to enable or disable the alarm at door 702. In some embodiments, the alarm enabled or disabled at door 702 is the alarm generated by process 1600 or all alarms together for door 702. In some embodiments, the alarm may be created or disabled at only ACS server 712, with no indication of an alarm at door 702.

Process 1600 is shown to include receiving, by the server, the sensitivity threshold for the door indicating a maximum number of AGDNU events (step 1604). For example, ACS server 712 may be configured to set the sensitivity threshold for door 702 indicating the maximum number of AGDNU events required to trigger an alarm. This configurable sensitivity threshold can be set to a number by a system monitor or by the ACS server 712.

Process 1600 is shown to include receiving, by the server, a suppression time period for the door indicating a length of time to suppress alarms after a particular alarm occurs (step 1606). For example, ACS server 712 may be configured to set the suppression time period for door 702 indicating a length of time to suppress alarms after a particular alarm occurs. This configurable time period can be shortened or lengthened by a system monitor or by the ACS server 712. In some embodiments, the suppression time period for door 702 may be used to suppress the alarms generated by process 1600 or all alarms together for door 702.

Process 1600 is shown to include detecting, by a security server, a number of AGDNU events for the door (step 1608). For example, ACS server 712 may receive an indication of multiple AGDNU events at door 702 and monitor the number of AGDNU that occur at door 702. ACS server 712 may log the number of events that occur along with any additional information from door 702. This information can include date, time, location, user credentials, security camera video, etc.

Process 1600 is shown to include generating, by the security server, the alarm for the door indicating that the number of AGDNU events for the door is more than the sensitivity threshold in response to a detection that the number of AGDNU events for the door is greater than the sensitivity threshold (step 1610). For example, if the number of AGDNU that occur at door 702 is more than the sensitivity threshold for door 702, set in step 1604, ACS server 712 may generate an alarm at door 702 and/or at ACS server 712 indicating that the number of AGDNU events for door 702 is more than the sensitivity threshold.

Still referring to FIG. 16, an LDD may be indicated when an unusual frequency of AGDNU events is detected. This can be detected in step 1608 of process 1600 and may occur when ACS server 712 authenticates access at door 702, but door sensor 704 or door lock 710 does not indicate to ACS server 712 that door 702 has been opened. This may occur when a user requests access to door 702 but does not open door 702. This may be due to the user deciding not to open door 702 or an LDD was applied to door 702. If an LDD is applied to door lock 710, door sensors 704 or door lock 710 may not signal that door 702 has been opened because door lock 710 has been compromised. The system may detect unusual frequencies of AGDNU events when compared to learned patterns of normal door events. The learned patterns of normal door events may be considered when deciding the sensitivity threshold indicating the maximum number of AGDNU events, step 1604, before the alarm is generated, step 1610.

Process 1600 is shown to include suppressing, by the security server, for the suppression time period, subsequent alarms generated for additional detections of other AGDNU events for the door (step 1512). For example, ACS server 712 my suppress alarms for the suppression time period, set in step 1606, for door 702 to prevent door 702 from triggering repeating alarms for the same AGDNU alert. Suppressing alarms may allow system monitors to better identify and prioritize genuine security concerns.

Referring now to FIG. 17, a flow diagram of a process 1700 describing a series of steps for detecting and generating an alarm indicating that a door held open (DHO) event occurs simultaneously with an authentication event at a door is shown, according to some embodiments. In embodiments, access reader module 708 as described with reference to FIG. 7, access controller 900 as described with reference to FIG. 9, and/or access control system (ACS) server 712 as described with reference to FIG. 10 are configured to perform some or all of the steps of process 1700. Furthermore any computing device described herein can be configured to perform the process 1700.

Process 1700 is shown to include receiving, by a server, an indication to enable or disable an alarm for a door (step 1702). For example, ACS server 712 may be configured to enable or disable the alarm at door 702. In some embodiments, the alarm enabled or disabled at door 702 is the alarm generated by process 1700 or all alarms together for door 702. In some embodiments, the alarm may be created or disabled at only ACS server 712, with no indication of an alarm at door 702.

Process 1700 is shown to include receiving, by the server, a suppression time period for the door indicating a length of time to suppress alarms after a particular alarm occurs (step 1704). For example, ACS server 712 may be configured to set the suppression time period for door 702 indicating a length of time to suppress alarms after a particular alarm occurs. This configurable time period can be shortened or lengthened by a system monitor or by the ACS server 712. In some embodiments, the suppression time period for door 702 may be used to suppress the alarms generated by process 1700 or all alarms together for door 702.

Process 1700 is shown to include detecting, by a security server, whether the DHO event occurs simultaneously with the authentication event for the door (step 1706). For example, ACS server 712 may receive an indication of a DHO event at door 702 and an access request from access module 708 resulting in an authentication event at the same time Process 1700 is shown to include generating, by the security server, the alarm for the door indicating that the DHO event occurs simultaneously with the authentication event in response to a detection that the DHO event occurs simultaneously with the authentication event (step 1708). For example, if the DFO event and the authentication event from step 1706 occur simultaneously, ACS server 712 may generate an alarm at door 702 and/or at ACS server 712 indicating that the DFO event occurs simultaneously with the authentication event at door 702.

Still referring to FIG. 17, an LDD may be detected when the DHO event is in progress when a genuine authentication event occurs. This may happen in several ways, such as a user may authenticate access at access reader module 708 and then hold door 702 open, for example, to allow other users to pass through or while the user is distracted or in conversation, or an LDD may have been applied to door lock 710. Door 702 may appear to be closed, so users may authenticate access at access reader module 708 before using door 702. If door 702 were visibly propped open, users may not authenticate access at access reader module 708. The approach described assumes that, given the concealed nature of an LDD, ACS server 712 may register a large number of authentication events concurrent with live DHO events at door 702.

Process 1700 is shown to include suppressing, by the security server, for the suppression time period, subsequent alarms generated for additional detections of other DHO events occurring simultaneously with other authentication events for the door (step 1710). For example, ACS server 712 my suppress alarms for the suppression time period, set in step 1704, for door 702 to prevent door 702 from triggering repeating alarms for the same DHO event occurring simultaneously with authentication events alert. Suppressing alarms may allow system monitors to better identify and prioritize genuine security concerns.

Configuration of Exemplary Embodiments

The construction and arrangement of the systems and methods as shown in the various exemplary embodiments are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.). For example, the position of elements may be reversed or otherwise varied and the nature or number of discrete elements or positions may be altered or varied. Accordingly, all such modifications are intended to be included within the scope of the present disclosure. The order or sequence of any process or method steps may be varied or re-sequenced according to alternative embodiments. Other substitutions, modifications, changes, and omissions may be made in the design, operating conditions and arrangement of the exemplary embodiments without departing from the scope of the present disclosure.

The present disclosure contemplates methods, systems and program products on any machine-readable media for accomplishing various operations. The embodiments of the present disclosure may be implemented using existing computer processors, or by a special purpose computer processor for an appropriate system, incorporated for this or another purpose, or by a hardwired system. Embodiments within the scope of the present disclosure include program products comprising machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. When information is transferred or provided over a network or another communications connection (either hardwired, wireless, or a combination of hardwired or wireless) to a machine, the machine properly views the connection as a machine-readable medium. Thus, any such connection is properly termed a machine-readable medium. Combinations of the above are also included within the scope of machine-readable media. Machine-executable instructions include, for example, instructions and data which cause a general purpose computer, special purpose computer, or special purpose processing machines to perform a certain function or group of functions.

Although the figures show a specific order of method steps, the order of the steps may differ from what is depicted. Also two or more steps may be performed concurrently or with partial concurrence. Such variation will depend on the software and hardware systems chosen and on designer choice. All such variations are within the scope of the disclosure. Likewise, software implementations could be accomplished with standard programming techniques with rule based logic and other logic to accomplish the various connection steps, processing steps, comparison steps and decision steps.

What is claimed is:

1. A building security system, the building security system comprising:

a door analysis system for a building for detecting a lock defeat device (LDD) installed at a door of the building, the door analysis system comprising a processing circuit configured to:

receive door data for the door of the building from an access control system, the door data comprising a plurality of door events;

determine whether the LDD has been installed at the door by analyzing the plurality of door events with one or more LDD indicators; and generate an LDD event indicating that the LDD has been installed at the door in response to a determination that the LDD has been installed at the door based on an analysis with the one or more LDD indicators.

2. The building security system of claim 1, wherein the building security system comprises the access control system, the access control system comprising:

a door lock for the door, the door lock configured to lock or unlock the door, wherein the lock defeat device is installed at the door lock of the door and prevents the door lock from locking the door; and a controller configured to:

cause the door lock of the door to lock the door or unlock the door;

collect the door data for the door; and communicate, via a network, the door data for the door to the door analysis system.

3. The building security system of claim 1, wherein the processing circuit is configured to:

receive a suppression time period, the suppression time period indicating a length of time to suppress the LDD event for the door;

determine a second LDD event subsequent to determining the LDD event; and suppress the second LDD event in response to the second LDD event occurring within the suppression time period from the LDD event occurring.

4. The building security system of claim 1, wherein the processing circuit is configured to:

collect historical data indicating usage patterns of the door from the access control system;

perform machine learning with the historical data to generate the one or more LDD indicators;

collect new historical data from the access control system, the new historical data occurring after the collected historical data, the new historical data indicating new usage patterns of the door; and perform additional machine learning with the new historical data to generate updates to the one or more LDD indicators, the updates comprising at least one of generating a new LDD indicator or adjusting an existing LDD indicator of the one or more LDD indicators.

5. The building security system of claim 1, wherein the plurality of events comprise a door forced open (DFO) event and an authentication event, wherein the one or more LDD indicators comprises a co-occurs indicator;

wherein the processing circuit is configured to analyze the plurality of door events with the co-occurs indicator by:

determining whether the DFO event occurs within a predefined amount of time of the authentication event occurring; and generating the LDD event in response to a determination that the DFO event occurs within the predefined amount of time of the authentication event occurring.

6. The building security system of claim 1, wherein the plurality of events comprise a plurality of access granted but door not used (AGDNU) events, each of the plurality of AGDNU events indicating that the door was unlocked but the door was not opened, wherein the one or more LDD indicators comprises a high AGDNU indicator;

wherein the processing circuit is configured to analyze the plurality of door events with the high AGDNU indicator by:

determining a number of the plurality of AGDNU events based on the plurality of AGDNU events;

determining whether the number of the AGDNU events is greater than a sensitivity threshold; and generating the LDD event in response to a determination that the number of the AGDNU events is greater than the sensitivity threshold.

7. The building security system of claim 1, wherein the plurality of events comprise a door held open (DHO) event and an authentication event, wherein the one or more LDD indicators comprises an in-progress indicator;

wherein the processing circuit is configured to analyze the plurality of door events with the in-progress indicator by:

determining that the authentication event occurs while the DHO event is occurring; and generating the lock defeat device event in response to a determination that the authentication event occurs while the DHO event is occurring.

8. The building security system of claim 1, wherein the processing circuit is configured to:

generate a risk score for the building, the risk score indicating an amount of risk that the building is experiencing; and update a value of the risk score in response to a generation of the LDD event.

9. The building security system of claim 1, wherein analyzing the door data for the door with the one or more LDD indicators comprises determining whether criteria of each of the one or more LDD indicators is met based on the plurality of door events;

wherein the processing circuit is configured to generate the LDD event indicating that the LDD has been installed at the door in response to the determination that the LDD has been installed at the door based on the criteria of at least one of the one or more LDD indications being met based on the door events.

10. The building security system of claim 9, wherein the LDD event can be a plurality of different LDD events, each type of the LDD event corresponding to one of the one or more LDD indicators.

11. A method for detecting a lock defeat device (LDD) installed at a door of a building, the method comprising:

receiving, by a door analysis system, door data for the door of the building from an access control system, the door data comprising a plurality of door events;

determining, by the door analysis system, whether the LDD has been installed at the door by analyzing the plurality of door events with one or more LDD indicators; and generating, by the door analysis system, an LDD event indicating that the LDD has been installed at the door in response to a determination that the LDD has been installed at the door based on an analysis with the one or more LDD indicators.

12. The method of claim 11, further comprising:

receiving, by the door analysis system, a suppression time period, the suppression time period indicating a length of time to suppress the LDD event for the door;

determining, by the door analysis system, a second LDD event subsequent to determining the LDD event; and suppressing, by the door analysis system, the second LDD event in response to the second LDD event occurring within the suppression time period from the LDD event occurring.

13. The method of claim 11, further comprising:

collecting, by the door analysis system, historical data indicating usage patterns of the door from the access control system;

performing, by the door analysis system, machine learning with the historical data to generate the one or more LDD indicators;

collecting, by the door analysis system, new historical data from the access control system, the new historical data occurring after the collected historical data, the new historical data indicating new usage patterns of the door; and performing, by the door analysis system, additional machine learning with the new historical data to generate updates to the one or more LDD indicators, the updates comprising at least one of generating a new LDD indicator or adjusting an existing LDD indicator of the one or more LDD indicators.

14. The method of claim 11, wherein the plurality of events comprise a door forced open (DFO) event and an authentication event, wherein the one or more LDD indicators comprises a co-occurs indicator;

wherein analyzing, by the analysis system, the plurality of door events with the co-occurs indicator comprises:

determining, by the analysis system, whether the DFO event occurs within a predefined amount of time of the authentication event occurring; and generating, by the analysis system, the LDD event in response to a determination that the DFO event occurs within the predefined amount of time of the authentication event occurring.

15. The method of claim 11, wherein the plurality of events comprise a plurality of access granted but door not used (AGDNU) events, each of the plurality of AGDNU events indicating that the door was unlocked but the door was not opened, wherein the one or more LDD indicators comprises a high AGDNU indicator;

wherein analyzing, by the analysis system, the plurality of door events with the high AGDNU indicator comprises:

determining, by the analysis system, a number of the plurality of AGDNU events based on the plurality of AGDNU events;

determining, by the analysis system, whether the number of the AGDNU events is greater than a sensitivity threshold; and generating, by the analysis system, the LDD event in response to a determination that the number of the AGDNU events is greater than the sensitivity threshold.

16. The method of claim 11, wherein the plurality of events comprise a door held open (DHO) event and an authentication event, wherein the one or more LDD indicators comprises an in-progress indicator;

wherein analyzing, by the analysis system, the plurality of door events with the in-progress indicator comprises:

determining, by the analysis system, that the authentication event occurs while the DHO event is occurring; and generating, by the analysis system, the lock defeat device event in response to a determination that the authentication event occurs while the DHO event is occurring.

17. An access control system for a building, the access control system comprising:

a door lock for a door, the door lock configured to lock or unlock the door, wherein a lock defeat device is installed at the door lock of the door and prevents the door lock from locking the door; and a processing circuit configured to:

receive door data for the door of the building, the door data comprising a plurality of door events;

determine whether the LDD has been installed at the door by analyzing the plurality of door events with one or more LDD indicators; and generate an LDD event indicating that the LDD has been installed at the door in response to a determination that the LDD has been installed at the door based on an analysis with the one or more LDD indicators.

18. The system of claim 17, wherein the plurality of events comprise a door forced open (DFO) event and an authentication event, wherein the one or more LDD indicators comprises a co-occurs indicator;

wherein the processing circuit is configured to analyze the plurality of door events with the co-occurs indicator by:

determining whether the DFO event occurs within a predefined amount of time of the authentication event occurring; and generating the LDD event in response to a determination that the DFO event occurs within the predefined amount of time of the authentication event occurring.

19. The system of claim 17, wherein the plurality of events comprise a plurality of access granted but door not used (AGDNU) events, each of the plurality of AGDNU events indicating that the door was unlocked but the door was not opened, wherein the one or more LDD indicators comprises a high AGDNU indicator;

wherein the processing circuit is configured to analyze the plurality of door events with the high AGDNU indicator by:

determining a number of the plurality of AGDNU events based on the plurality of AGDNU events;

determining whether the number of the AGDNU events is greater than a sensitivity threshold; and generating the LDD event in response to a determination that the number of the AGDNU events is greater than the sensitivity threshold.

20. The system of claim 17, wherein the plurality of events comprise a door held open (DHO) event and an authentication event, wherein the one or more LDD indicators comprises an in-progress indicator;

wherein the processing circuit is configured to analyze the plurality of door events with the in-progress indicator by:

determining that the authentication event occurs while the DHO event is occurring; and generating the lock defeat device event in response to a determination that the authentication event occurs while the DHO event is occurring.

* * * * *